US008639156B2

(12) United States Patent
Itabashi

(10) Patent No.: US 8,639,156 B2
(45) **Date of Patent: *Jan. 28, 2014**

(54) IMAGE-FORMING DEVICE HAVING HOLDER UNIT, IN WHICH TONER BOX IS DETACHABLY MOUNTED

(75) Inventor: Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 129 days.

This patent is subject to a terminal disclaimer.

(21) Appl. No.: 13/073,800

(22) Filed: Mar. 28, 2011

(65) Prior Publication Data

US 2011/0280616 A1 Nov. 17, 2011

(30) Foreign Application Priority Data

May 17, 2010 (JP) ..... 2010-113666

(51) Int. Cl.
*G03G 15/01* (2006.01)
*G03G 15/08* (2006.01)

(52) U.S. Cl.
USPC ..... 399/110; 399/112; 399/119; 399/258

(58) Field of Classification Search
USPC ..... 399/110, 112, 119, 120, 258, 262
See application file for complete search history.

(56) References Cited

U.S. PATENT DOCUMENTS 4,937,628 A 6/1990 Cipolla et al.
5,419,468 A 5/1995 Taki
5,608,501 A 3/1997 Makino
5,999,770 A 12/1999 Li
6,097,907 A 8/2000 Fujiwara
6,185,401 B1 2/2001 Kanamori et al.
6,215,974 B1 4/2001 Katoh et al.
6,324,370 B1 11/2001 Isobe et al.
6,564,029 B2 5/2003 Kojima et al.
7,062,195 B2 6/2006 Kurihara et al.

(Continued)

FOREIGN PATENT DOCUMENTS

CN 1828443 A 9/2006
CN 101403882 A 4/2009

(Continued)

OTHER PUBLICATIONS

United States Patent and Trademark Office, Non-Final Office Action for U.S. Appl. No. 13/073,906 (related U.S. patent application), mailed Dec. 21, 2012.

(Continued)

*Primary Examiner* — Sophia S Chen
(74) *Attorney, Agent, or Firm* — Baker Botts L.L.P.

(57) ABSTRACT

In an image forming device, a holder unit is movable in a moving direction between an accommodated position and a pull-out position. A plurality of toner boxes are detachably attachable to the holder unit in one to one correspondence with the plurality of developing units. Each toner box is detachably attachable to the holder unit at the pull-out position. Each toner box includes: a toner container accommodating therein toner and formed with an opening through which toner in the toner container is to be supplied to each developing unit; and a shutter movable between an open position for opening the opening and a closed position for closing the opening. An operation assembly is provided at the holder unit and configured to move the shutter between the open position and the closed position.

19 Claims, 21 Drawing Sheets

(56) References Cited

U.S. PATENT DOCUMENTS

| | | | | |
|---|---|---|---|---|
| 8,358,953 | B2 * | 1/2013 | Itabashi | 399/110 |
| 2002/0141777 | A1 | 10/2002 | Kamimura et al. | |
| 2006/0067734 | A1 | 3/2006 | Igarashi | |
| 2006/0140652 | A1 | 6/2006 | Itabashi | |
| 2006/0285885 | A1 | 12/2006 | Lee | |
| 2009/0087215 | A1 | 4/2009 | Sakuma | |
| 2009/0087216 | A1 | 4/2009 | Sakuma | |
| 2009/0142079 | A1 | 6/2009 | Sato et al. | |
| 2009/0169267 | A1 | 7/2009 | Sakuma | |
| 2009/0190963 | A1 | 7/2009 | Nozawa | |
| 2009/0245854 | A1 | 10/2009 | Sakuma | |
| 2010/0021201 | A1 | 1/2010 | Tamaru | |
| 2010/0054798 | A1 | 3/2010 | Sato | |
| 2010/0054800 | A1 | 3/2010 | Okabe | |
| 2010/0067947 | A1 | 3/2010 | Yuzawa | |
| 2011/0280610 | A1 | 11/2011 | Itabashi | |
| 2011/0280611 | A1 | 11/2011 | Itabashi | |
| 2011/0280612 | A1 | 11/2011 | Itabashi | |
| 2011/0280630 | A1 | 11/2011 | Itabashi | |
| 2011/0299878 | A1 * | 12/2011 | Kamimura | 399/110 |
| 2011/0299879 | A1 * | 12/2011 | Kamimura | 399/110 |
| 2012/0003000 | A1 * | 1/2012 | Nishiyama et al. | 399/110 |
| 2012/0033988 | A1 * | 2/2012 | Itabashi | 399/106 |

FOREIGN PATENT DOCUMENTS

| | | | |
|---|---|---|---|
| JP | S64-029656 | U | 2/1989 |
| JP | H05-257340 | A | 10/1993 |
| JP | H05-289513 | A | 11/1993 |
| JP | H06-035322 | A | 2/1994 |
| JP | H07-168428 | A | 7/1995 |
| JP | H07-225514 | A | 8/1995 |
| JP | H08-022187 | A | 1/1996 |
| JP | H08-292635 | A | 11/1996 |
| JP | H09-230684 | A | 9/1997 |
| JP | H09-269639 | A | 10/1997 |
| JP | H09-269716 | A | 10/1997 |
| JP | H10-142912 | A | 5/1998 |
| JP | H11-212349 | A | 8/1998 |
| JP | H11-084838 | A | 3/1999 |
| JP | H11-166409 | A | 6/1999 |
| JP | 2000-029300 | A | 1/2000 |
| JP | 2000-187378 | A | 7/2000 |
| JP | 2001-083788 | A | 3/2001 |
| JP | 2001-083792 | A | 3/2001 |
| JP | 2001-125359 | A | 5/2001 |
| JP | 2001-194884 | A | 7/2001 |
| JP | 2002-055524 | A | 2/2002 |
| JP | 2003-107892 | A | 4/2003 |
| JP | 2006-098772 | A | 4/2006 |
| JP | 2006-171397 | A | 6/2006 |
| JP | 2006-227662 | A | 8/2006 |
| JP | 2007-121942 | A | 5/2007 |
| JP | 2008-191578 | A | 8/2008 |
| JP | 2009-058722 | A | 3/2009 |
| JP | 2009-086479 | A | 4/2009 |
| JP | 2009-139489 | A | 6/2009 |
| JP | 2009-157204 | A | 7/2009 |
| JP | 2009-169308 | A | 7/2009 |
| JP | 2009-175403 | A | 8/2009 |
| JP | 2009-237252 | A | 10/2009 |
| JP | 2010-032573 | A | 2/2010 |
| JP | 2010-054837 | A | 3/2010 |
| JP | 2010-072307 | A | 4/2010 |
| JP | 2010-079295 | A | 4/2010 |

OTHER PUBLICATIONS

European Patent Office, partial European Search Report for European Patent Application No. 11160300.7 (counterpart European patent application), dated Jan. 22, 2013.

State Intellectual Property Office of the People's Republic of China, The First Office Action for Chinese Patent Application No. 201110090810.7 (counterpart Chinese patent application), mailed Jan. 11, 2013.

State Intellectual Property Office of the People's Republic of China, The First Office Action for Chinese Patent Application No. 201110090791.8 (counterpart Chinese patent application), mailed Jan. 11, 2013.

State Intellectual Property Office of the People's Republic of China, The First Office Action for Chinese Patent Application No. 201110090794.1 (counterpart Chinese patent application), mailed Jan. 11, 2013.

Japan Patent Office, Decision to Grant for Japanese Patent Application No. 2010-113667 (counterpart to above-captioned patent application), mailed Feb. 7, 2012.

Japan Patent Office, Decision to Grant for Japanese Patent Application No. 2010-113668 (counterpart to above-captioned patent application), mailed Feb. 7, 2012.

Japan Patent Office, Office Action for Japanese Patent Application No. 2010-113670 (counterpart to above-captioned patent application), mailed Feb. 7, 2012.

Japan Patent Office, Office Action for Japanese Patent Application No. 2010-113666 (counterpart to above-captioned patent application), mailed Apr. 3, 2012.

English Language Translation of Japanese Patent Application Publication No. 2000-187378 A.

United States Patent and Trademark Office, Office Action for U.S. Appl. No. 13/074,191 (related US patent application), mailed Nov. 5, 2012.

United States Patent and Trademark Office, Office Action for U.S. Appl. No. 13/075,136 (related US patent application), mailed Nov. 6, 2012.

European Patent Office, extended European Search Report for European Patent Application No. 11160311.4 (counterpart to above-captioned patent application), dated Sep. 5, 2011.

European Patent Office, extended European Search Report for European Patent Application No. 11160154.8 (counterpart to above-captioned patent application), dated Sep. 7, 2011.

State Intellectual Property Office of the People's Republic of China, Notification of Second Office Action for Chinese Patent Application No. 201110090791.8 (related to above-captioned patent application), mailed Aug. 6, 2013.

European Patent Office, extended European Search Report for European Patent Application No. 11160300.7 (counterpart European patent application), dated Apr. 19, 2013.

State Intellectual Property Office of the People's Republic of China, Notification of Second Office Action for Chinese Patent Application No. 201110141356.3 (counterpart to above-captioned patent application), mailed Sep. 3, 2013.

* cited by examiner

IMAGE-FORMING DEVICE HAVING HOLDER UNIT, IN WHICH TONER BOX IS DETACHABLY MOUNTED

CROSS REFERENCE TO RELATED APPLICATION

This application claims priority from Japanese Patent Application No. 2010-113666 filed May 17, 2010. The entire content of this priority application is incorporated herein by reference.

TECHNICAL FIELD

The present invention relates to an image forming device such as a laser printer.

BACKGROUND

According to a conventional tandem type color printer, four photosensitive drums for the colors of yellow magenta, cyan and black can be integrally attached to or detached from a main casing.

In such type of color printer, a frame can be pulled out in a horizontal direction from the main casing, and four photosensitive drums are held in the frame and arrayed in a pull-out direction of the frame. Further, developing cartridges provided with developing rollers and corresponding to these photosensitive drums are detachably mounted on the frame from the above. If toner in a developing cartridge gets empty, the developing cartridge is taken out of the frame, and a new developing cartridge is mounted on the frame.

SUMMARY

Recently, a low cost and environmentally preferable printer is required. To this effect, exchange in toner box only is preferable rather than exchange in developer cartridge when the toner is used up. In the exchange in toner box only, only the toner box is exchanged with a new toner box while a developing roller remains in the frame.

It is an object of the invention to provide an improved image-forming device, in which a holder unit is movably provided and a toner box is detachably mounted in the holder unit.

In order to attain the above and other objects, the invention provides an image forming device including: a main casing; a holder unit; a plurality of image bearing members; a plurality of developing units; a plurality of toner boxes; and an operation assembly. The main casing defines an accommodation space. The holder unit is configured to be movable in a moving direction between an accommodated position in which the holder unit is accommodated in the accommodation space and a pull-out position in which at least part of the holder unit is outside of the accommodation space. The plurality of image bearing members are held by the holder unit and are juxtaposedly arrayed in the moving direction with intervals between neighboring image bearing members. The plurality of developing units are held by the holder unit in one to one correspondence with the plurality of image bearing members. The plurality of toner boxes are detachably attachable to the holder unit in one to one correspondence with the plurality of developing units. Each toner box is detachably attachable to the holder unit at the pull-out position. Each toner box includes: a toner container accommodating therein toner and formed with an opening through which toner in the toner container is to be supplied to each developing unit; and a shutter movable between an open position for opening the opening and a closed position for closing the opening. The operation assembly is provided at the holder unit and configured to move the shutter between the open position and the closed position.

DETAILED DESCRIPTION

Next, an embodiment of the present invention will be described while referring to the accompanying drawings.

1. Structure of a Color Printer

Figure 1:
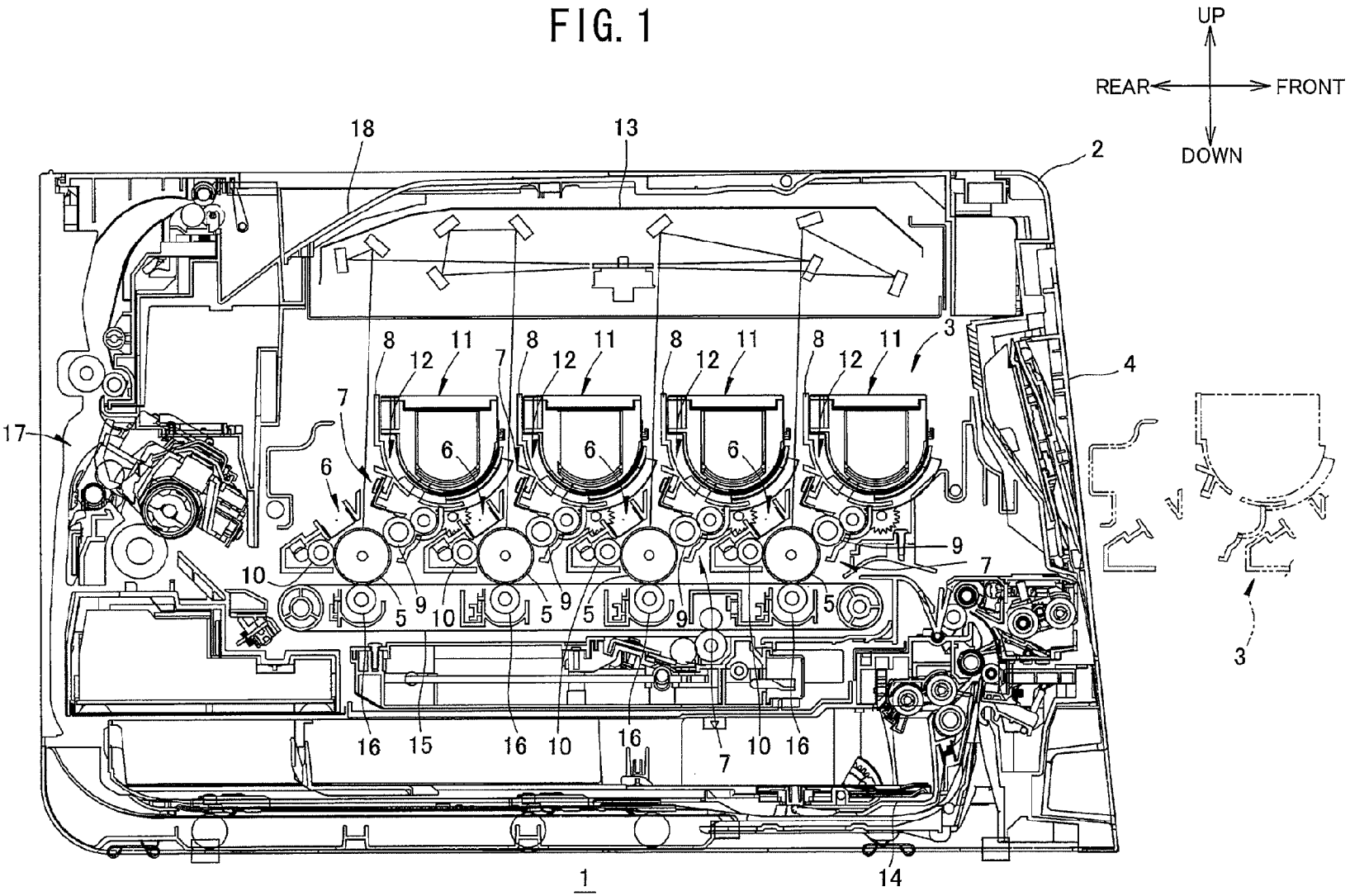
FIG. 1 is a cross-sectional view of a color printer according to an embodiment of the present invention.
Figure 2:
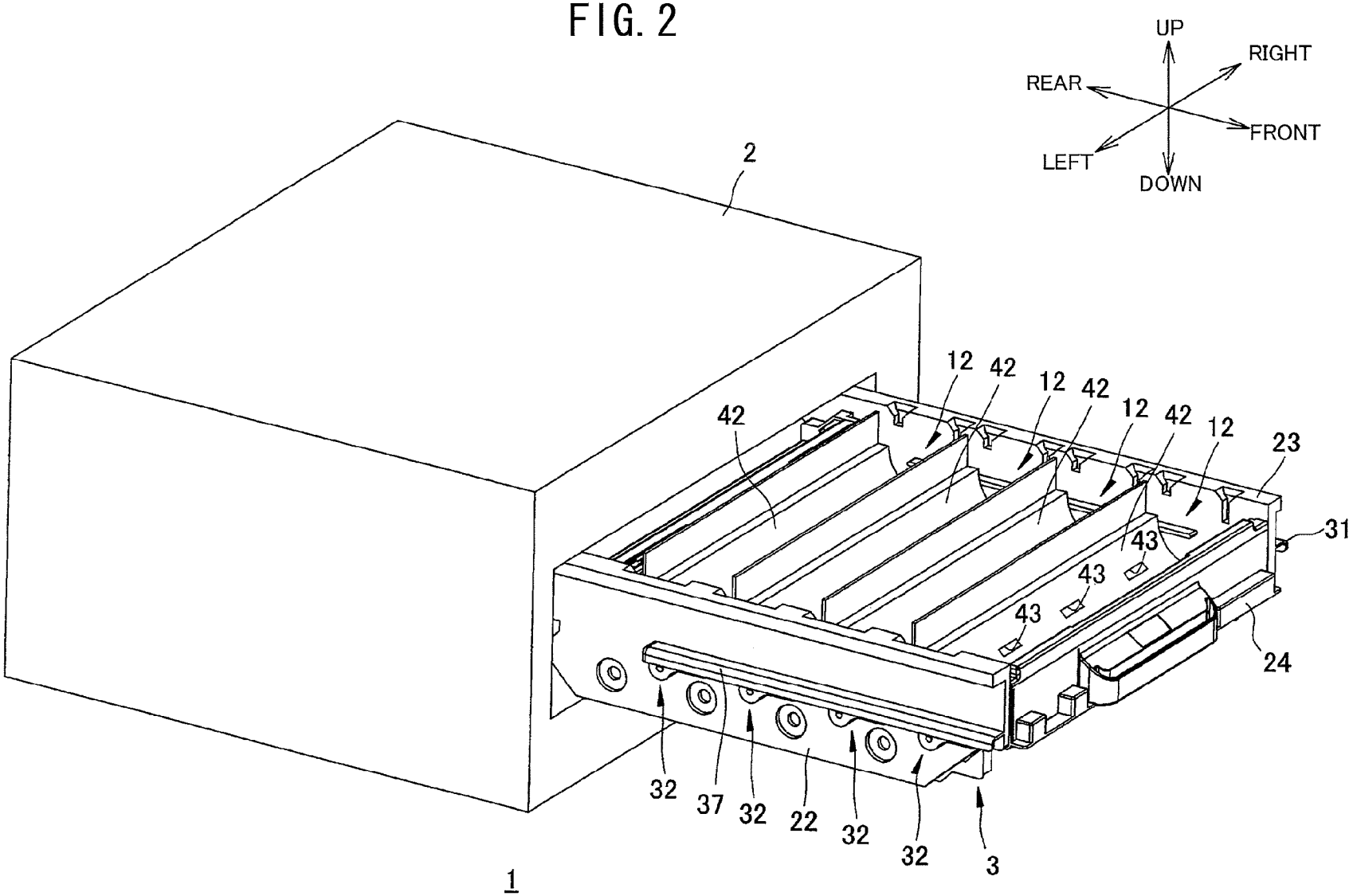
FIG. 2 is a perspective view of the color printer in FIG. 1 showing a drawer unit that has been pulled outward from a main frame of the printer.

As shown in FIG. 1, the image-forming device according to the embodiment is a tandem-type color printer 1. As shown in FIGS. 1 and 2, the color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2, as indicated by solid lines in FIG. 1, and a pull-out position outside the main casing 2, as depicted virtually by dotted lines in FIG. 1 and shown in FIG. 2. It is noted that when the drawer unit 3 is in the pull-out position, the drawer unit 3 protrudes outside the main casing 2 through an opening of the main casing 2 opened by the front cover 4, but is still partly mounted in the main casing 2. That is, when the drawer unit 3 is in the pull-out position, the drawer unit 3 is not detached from the main casing 2, but is still supported by the main casing 2. For example, a guide unit (not shown) is provided in the main casing 2 to guide the drawer unit 3 between the accommodated position and the pull-out position. The drawer unit 3 is slidably movable on the guide unit between the accommodated position and the pull-out position. So, even when the drawer unit 3 is in the pull-out position, the drawer unit 3 is still partly on the guide unit, and is therefore not detached from the main casing 2. Thus, also in the pull-out position, the drawer unit 3 is still mounted in the main casing 2, while partly protruding outside of the main casing 2.

In the following description, the side of the color printer 1 on which the front cover 4 is provided (right side in FIG. 1) will be referred to as the front side of the color printer 1. The top, bottom, left, and right sides of the color printer 1 in the following description will be based on the reference point of a user viewing the color printer 1 from the front side. Directions related to the drawer unit 3 and toner boxes 11, described later, that are mounted in the drawer unit 3 will be referenced based on their positions when mounted in the main casing 2, unless otherwise specified. Note that the front cover 4 has been omitted from FIG. 2.

As shown in FIG. 1, four photosensitive drums 5 (image-bearing members) are rotatably retained in the drawer unit 3. The photosensitive drums 5 are capable of rotating about axes extending in the left-to-right direction. The four photosensitive drums 5 are respectively provided for the colors black, yellow, magenta, and cyan. The photosensitive drums 5 are arranged parallel to each other at regular intervals in the front-to-rear direction in the order black, yellow, magenta, and cyan.

Four chargers 6 are also retained in the drawer unit 3. The chargers 6 have a one-on-one correspondence to the four photosensitive drums 5 and are disposed at positions diagonally upward and rearward from the corresponding photosensitive drums 5. Each charger 6 is a Scorotron charger that includes a discharge wire and grid, for example.

Four developing units 7 are also retained in the drawer unit 3. The four developing units 7 also have a one-on-one correspondence to the four photosensitive drums 5 and are disposed diagonally above and forward of the corresponding photosensitive drums 5. Each developing unit 7 includes a developing unit frame 8, and a developing roller 9 accommodated in the developing unit frame 8. The developing roller 9 is disposed in contact with the photosensitive drum 5 and is capable of rotating about an axis extending in the left-to-right direction.

Four cleaners 10 are also retained in the drawer unit 3. The cleaners 10 are provided with a one-on-one correspondence to the four photosensitive drums 5 and are positioned rearward of the corresponding photosensitive drums 5. The cleaners 10 function to move paper dust and the like deposited on the surfaces of the photosensitive drums 5.

A space 12 is provided in the drawer unit 3 above each developing unit 7. A toner box 11 that accommodates toner is mounted in the space 12 formed above each developing unit 7. Sufficient room above the drawer unit 3 for mounting the toner boxes 11 in the spaces 12 is acquired by pulling the drawer unit 3 outward to the pull-out position. The toner boxes 11 supply toner to the corresponding developing units 7.

An exposure device 13 is provided in the main casing 2 above the drawer unit 3. The exposure device 13 irradiates four laser beams corresponding to the four colors used by the color printer 1.

As each photosensitive drum 5 rotates, the corresponding charger 6 applies a uniform charge to the surface of the photosensitive drum 5 through corona discharge. Subsequently, the exposure device 13 irradiates laser beams for selectively exposing the surfaces of the photosensitive drums 5. This exposure selectively removes charge from the surfaces of the photosensitive drums 5, forming electrostatic latent images thereon. When the electrostatic latent image carried on the surface of a photosensitive drum 5 rotates to a position opposite the corresponding developing roller 9, the developing roller 9 supplies toner to the latent image, developing the image into a toner image. That is, the developing roller 9 executes a developing operation.

Here, four LED arrays may be provided for the four photosensitive drums 5 in place of the exposure device 13.

A paper cassette 14 accommodating sheets of a paper is disposed in a bottom section of the main casing 2. The paper accommodated in the paper cassette 14 is conveyed onto a conveying belt 15 by various rollers. The conveying belt 15 confronts the four photosensitive drums 5 from below. Four transfer rollers 16 are disposed inside the conveying belt 15 at positions confronting each of the photosensitive drums 5 through the upper portion of the conveying belt 15. When a sheet of paper is conveyed onto the conveying belt 15, the conveying belt 15 carries the sheet sequentially through positions between the conveying belt 15 and each of the photosensitive drums 5. As the sheet passes beneath each photosensitive drum 5, the toner image carried on the surface of the photosensitive drum 5 is transferred onto the paper.

A fixing unit 17 is provided on the downstream end of the conveying belt 15 with respect to the direction that the paper is conveyed. After toner images are transferred onto a sheet of paper, the sheet is conveyed to the fixing unit 17, where the toner images are fixed to the sheet by heat and pressure. After the toner images are fixed in the fixing unit 17, various rollers discharge the sheet onto a discharge tray 18 formed on the top surface of the main casing 2.

2. Drawer Unit (1) Drawer Frame

Figure 3:
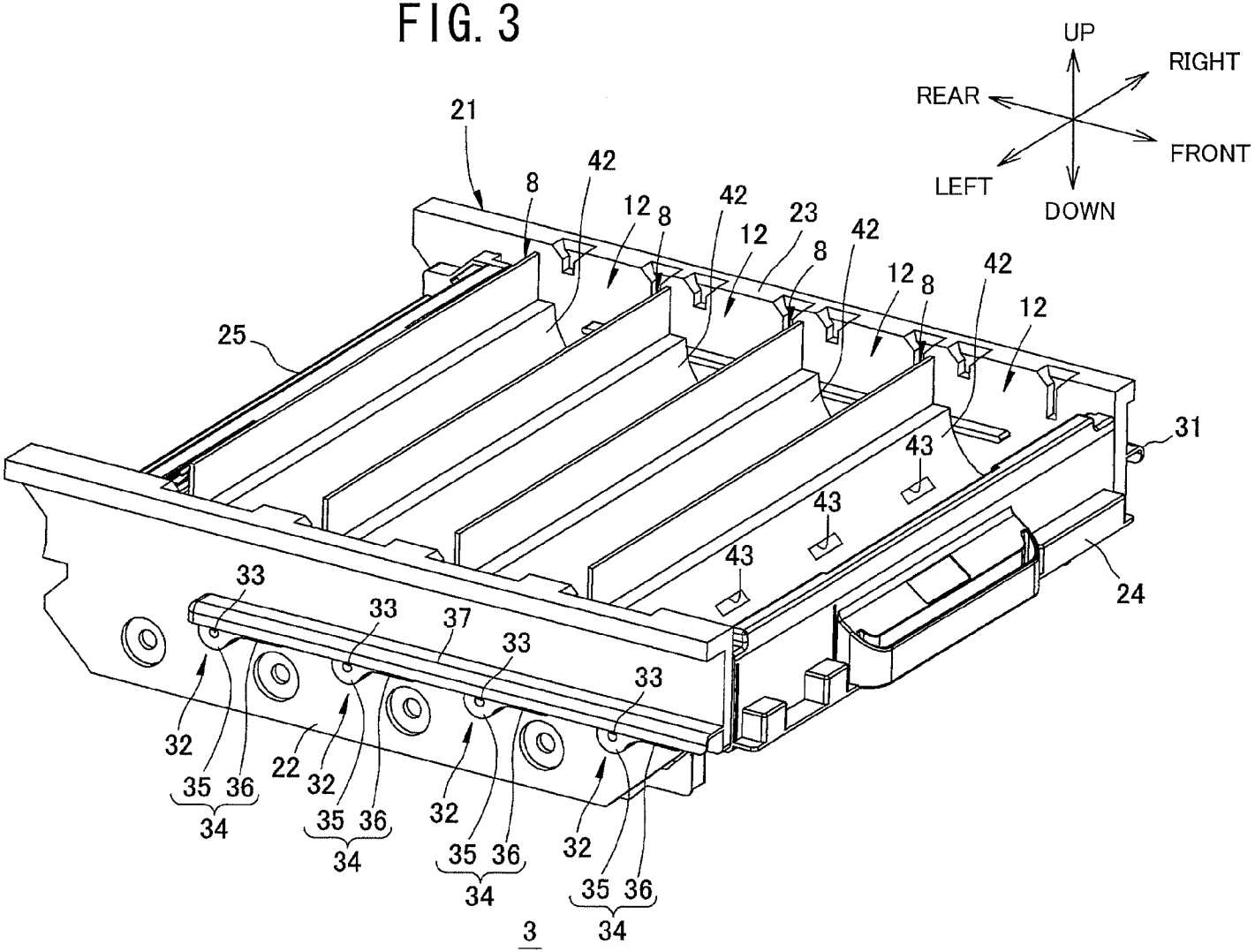
FIG. 3 is a perspective view of the drawer unit in FIG. 2 when toner boxes have all been removed.

As shown in FIG. 3, the drawer unit 3 has a drawer frame 21 (holder unit). The drawer frame 21 is configured of a pair of side plates 22 and 23 arranged parallel to each other and separated in the left-to-right direction, a front beam 24 bridging the front ends of the side plates 22 and 23, and a rear beam 25 bridging the rear ends of the side plates 22 and 23. The overall structure of the drawer frame 21 is square-shaped in a plan view.

The respective groups of four photosensitive drums 5, chargers 6, developing units 7, and cleaners 10 (see FIG. 1) are all held together between the side plates 22 and 23 on the left and right sides thereof. The spaces 12 in which the toner boxes 11 are mounted are formed between the side plates 22 and 23 above the corresponding developing units 7. In other words, the side plates 22 and 23 hold the photosensitive drums 5, chargers 6, developing units 7, and cleaners 10. Further, the side plates 22 and 23 oppose each other in the left-to-right direction, with gaps formed therebetween to allocate the spaces 12 in which the toner boxes 11 are mounted.

(2) Opening Members

Figure 4A:
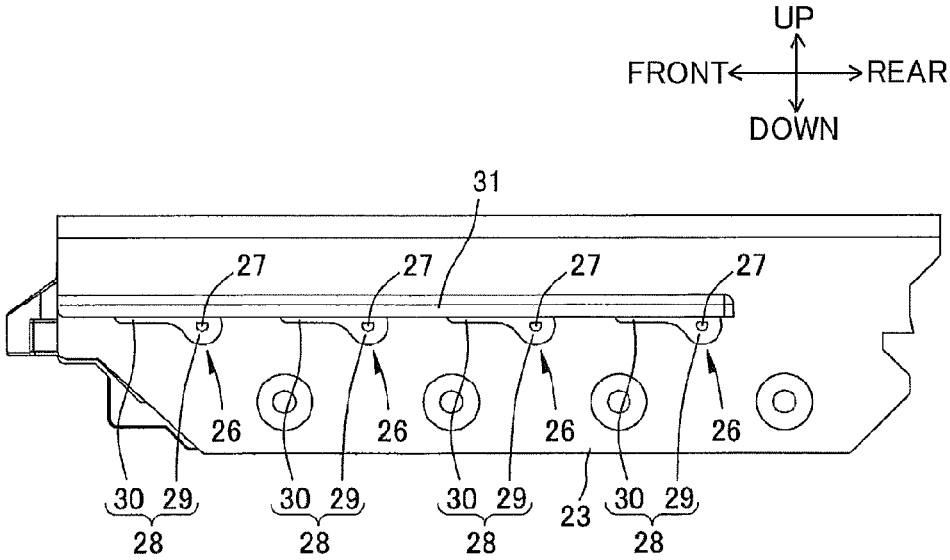
FIG. 4A is a right side view of the drawer unit in FIG. 2 when opening members are in a second position and shutters are in an open position.
Figure 5A:
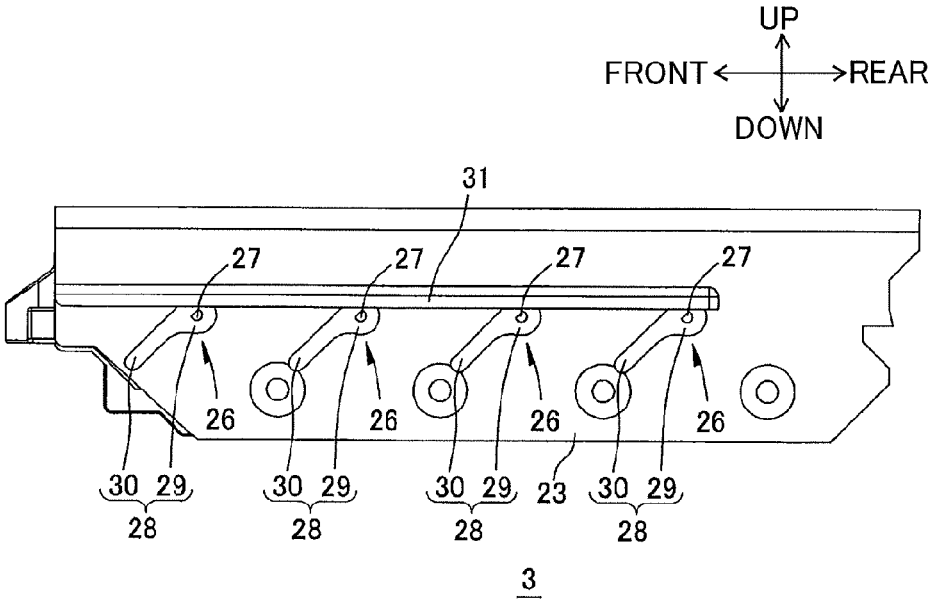
FIG. 5A is a right side view of the drawer unit when the opening members are in a first position and the shutters are in a closed position.

As shown in FIGS. 4A and 5A, four opening members 26 (operation assemblies or operation members) are disposed on the right side surface (outer surface) of the right side plate 23 at positions corresponding to the spaces 12. Each opening member 26 includes a rotating support part (fulcrum part) 27 configured of a shaft extending in the left-to-right direction, and a lever part 28 coupled to the rotating support part 27.

The rotating support part 27 is rotatably supported in the side plate 23.

The lever part 28 is integrally configured of a coupling part 29 having a circular shape in a side view, and an arm part 30 that has a narrow elongated plate shape extending forward from the coupling part 29, for example. The lever part 28 is coupled to the rotating support part 27 by inserting the rotating support part 27 into the coupling part 29 so that the rotating support part 27 cannot rotate relative to the coupling part 29.

By pivoting the opening member 26 with the rotating support part 27 serving as the fulcrum, the opening member 26 can be shifted between a first position in which the arm part 30 of the lever part 28 slopes diagonally forward and downward, as shown in FIG. 5A, and a second position in which the arm part 30 extends horizontally, as shown in FIG. 4A. Hence, the direction in which the opening member 26 moves from the first position to the second position (i.e., the rotating direction) is clockwise when viewing the opening member 26 from the right side.

A first cover 31 is disposed above the opening members 26 on the right side surface of the right side plate 23 for covering all four opening members 26 in the second position. In a cross-sectional view, the first cover 31 is L-shaped, extending rightward, then bending and extending downward. As shown in FIG. 4A, most of the upper half of the coupling part 29 and most of the entire arm part 30 constituting the lever part 28 are accommodated inside the first cover 31 (between the first cover 31 and the side plate 23) when the opening member 26 is in the second position. The first cover 31 is integrally formed with the side plate 23.

(3) Closing Members

Figure 4B:
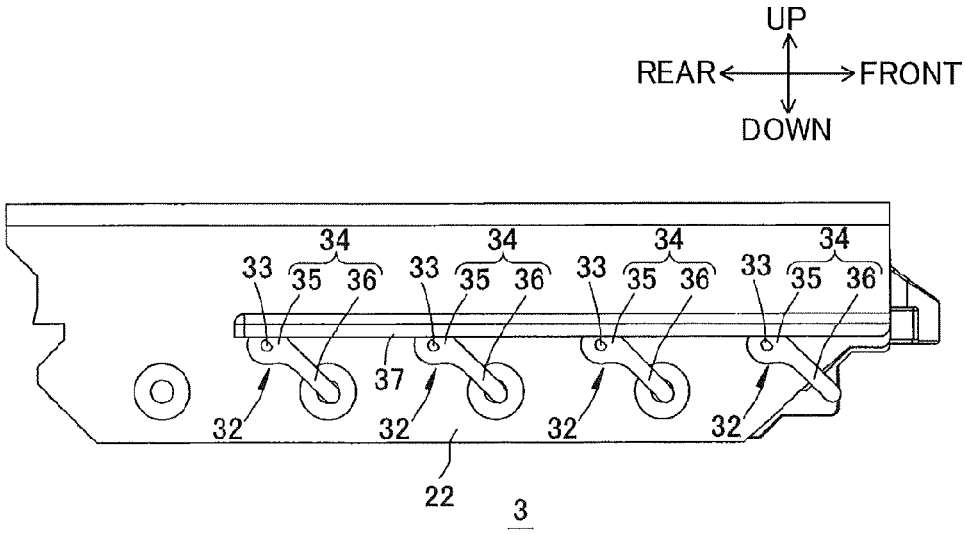
FIG. 4B is a left side view of the drawer unit when closing members are in a third position and the shutters are in the open position.
Figure 5B:
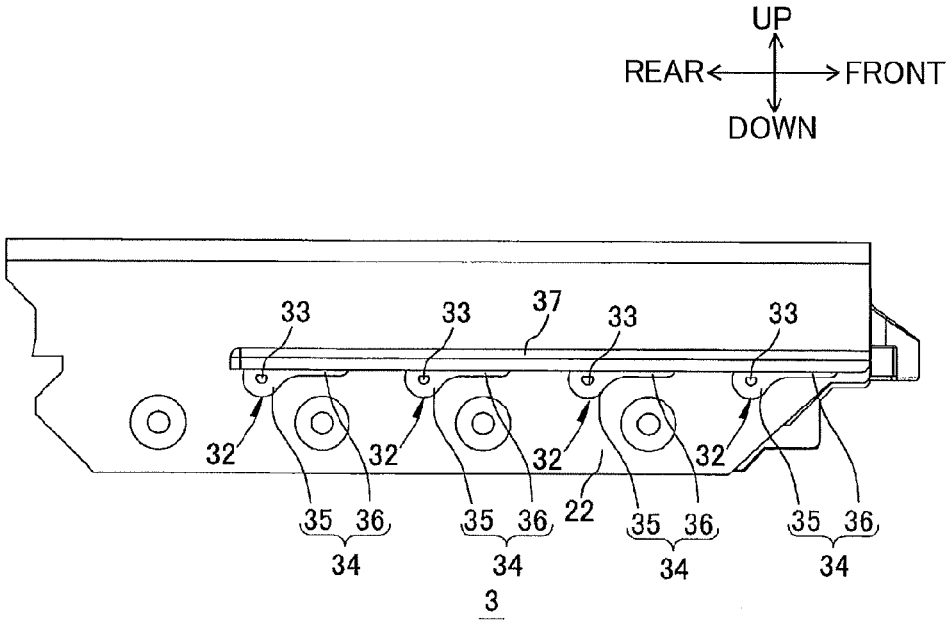
FIG. 5B is a left side view of the drawer unit when the closing members are in a fourth position and the shutters are in the closed position.

As shown in FIGS. 4B and 5B, four closing members 32 (operation assemblies or operation members) are disposed on the left side surface (outer surface) of the left side plate 22 at positions corresponding to the spaces 12. Each closing member 32 includes a rotating support part (fulcrum part) 33 configured of a shaft extending in the left-to-right direction, and a lever part 34 coupled to the rotating support part 33.

The rotating support part 33 is rotatably supported in the side plate 22.

The lever part 34 is integrally configured of a coupling part 35 having a circular shape in a side view, and an arm part 36 that has a narrow elongated plate shape extending forward from the coupling part 35, for example. The lever part 34 is coupled to the rotating support part 33 by inserting the rotating support part 33 into the coupling part 35 so that the rotating support part 33 cannot rotate relative to the coupling part 35.

By pivoting the closing member 32 with the rotating support part 33 serving as the fulcrum, the closing member 32 can be shifted between a third position in which the arm part 36 of the lever part 34 slopes diagonally forward and downward, as shown in FIG. 4B, and a fourth position in which the arm part 36 extends horizontally, as shown in FIG. 5B. Hence, the direction in which the closing member 32 moves from the third position to the fourth position (i.e., the rotating direction) is opposite the direction in which the opening member 26 moves from the first position to the second position, i.e., counterclockwise when viewing the closing member 32 from the left side.

A second cover 37 is disposed above the closing members 32 on the left side surface of the left side plate 22 for covering all four closing members 32 in the fourth position. In a cross-sectional view, the second cover 37 is L-shaped, extending leftward, then bending and extending downward. As shown in FIG. 5B, most of the upper half of the coupling part 35 and most of the entire arm part 36 constituting the lever part 34 are accommodated inside the second cover 37 (between the second cover 37 and the side plate 22) when the closing member 32 is in the fourth position. The second cover 37 is integrally formed with the side plate 22.

(4) Lever Interlocking Mechanism

Figure 6:
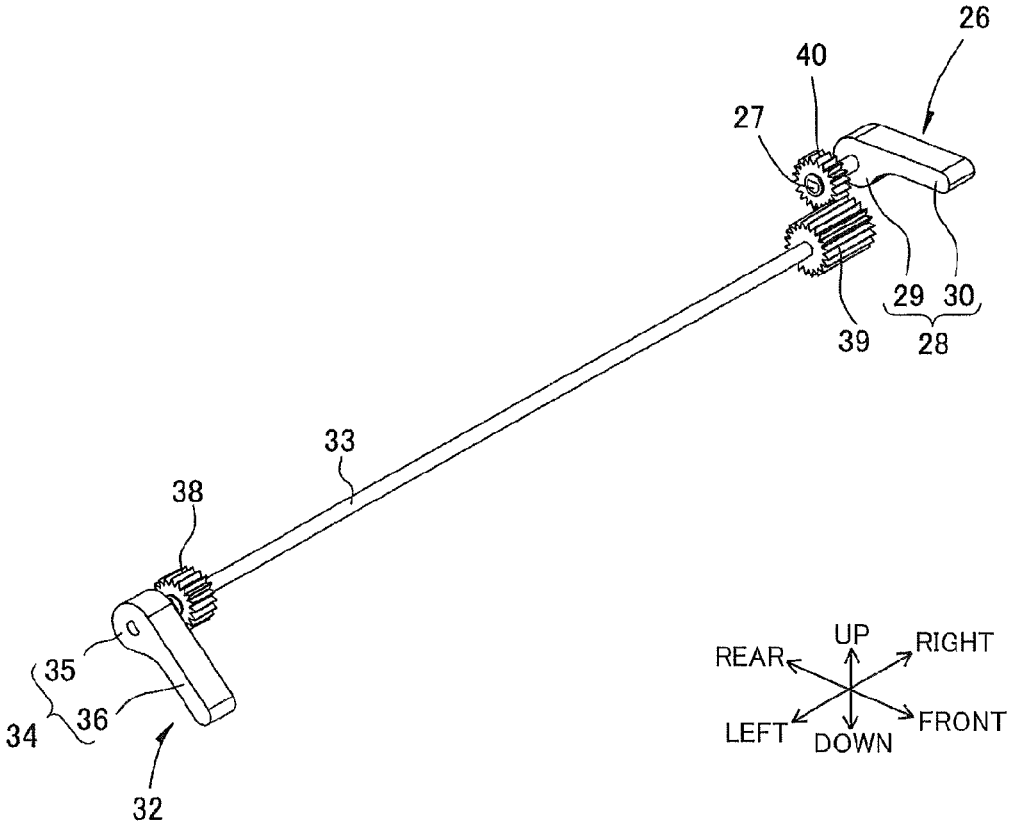
FIG. 6 is a perspective view of a mechanism for interlocking the opening member shown in FIG. 4A with the closing member shown in FIG. 4B.
Figure 7:
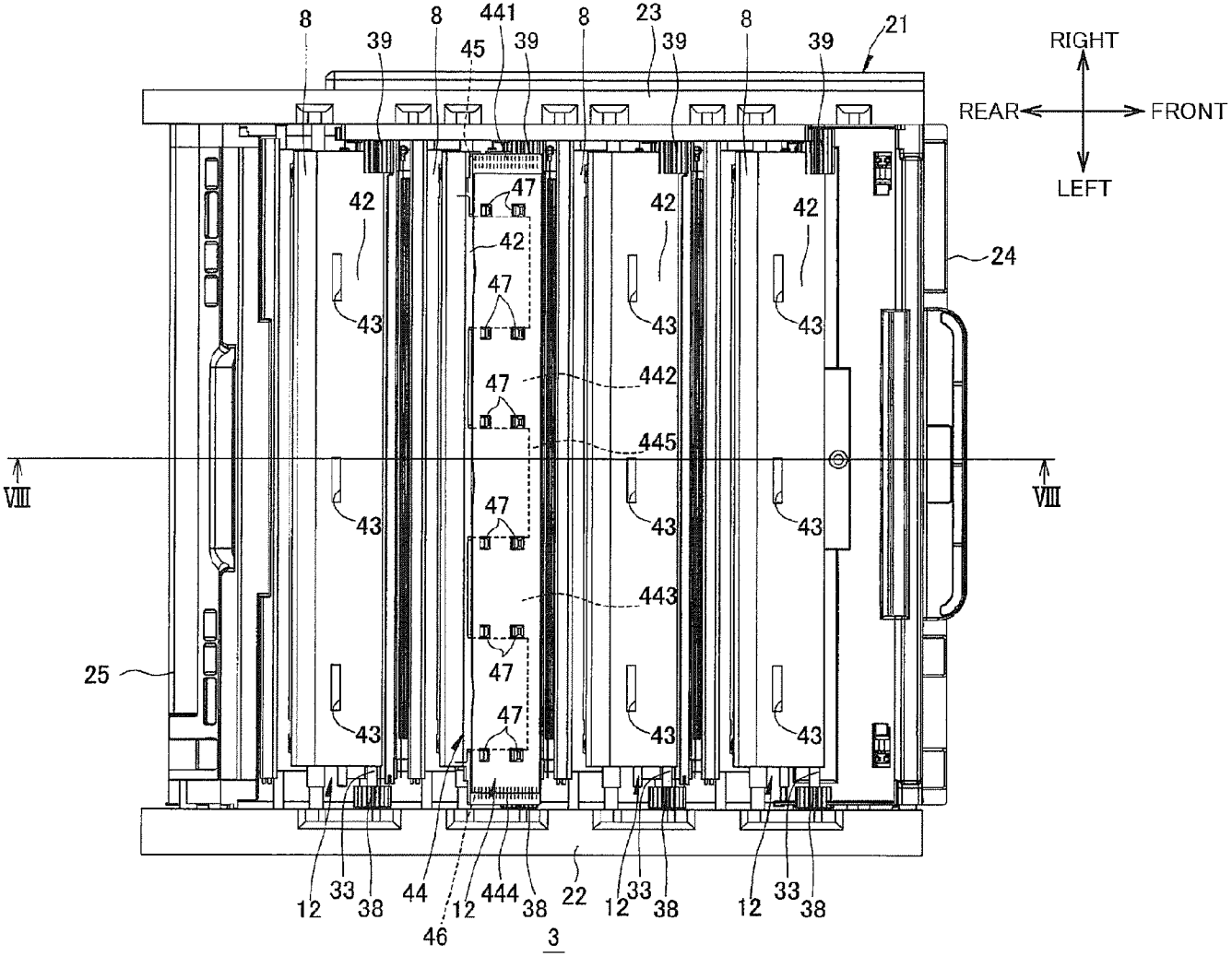
FIG. 7 is a plan view of the drawer unit in FIG. 3.

As shown in FIG. 6, the rotating support part 33 of the closing member 32 penetrates the left side plate 22 (see FIG. 3) and extends between the side plates 22 and 23 in the left-to-right direction. As shown in FIG. 7, a left pinion gear 38 is mounted on the left end of the rotating support part 33 to the right (inside) of the side plate 22 and is not capable of rotating relative to the rotating support part 33. A small gap is formed between the left pinion gear 38 and side plate 22 so that rotation of the left pinion gear 38 is not hindered. Similarly, a right pinion gear 39 is mounted on the right end of the rotating support part 33 to the left (inside) of the side plate 23 and is not capable of rotating relative to the rotating support part 33. The right pinion gear 39 is longer than the left pinion gear 38 in the left-to-right direction. A small gap is formed between the right pinion gear 39 and side plate 23 so that rotation of the right pinion gear 39 is not hindered.

The rotating support part 27 of each opening member 26 penetrates the right side plate 23 (see FIG. 3). As shown in FIG. 6, the left end of the rotating support part 27 opposes the right pinion gear 39 from the upper rear side. A pinion gear 40 is mounted on the left end of the rotating support part 27 and is incapable of rotating relative to the rotating support part 27. The pinion gear 40 is engaged with the right pinion gear 39.

As shown in FIGS. 4A, 4B, and 6, the positions of the opening members 26 and closing members 32 mounted on the drawer frame 21 are adjusted so that the closing members 32 are in their third positions when the opening members 26 are in their second positions.

When a closing member 32 is moved from the third position to the fourth position, the corresponding rotating support part 33, left pinion gear 38, and right pinion gear 39 rotate counterclockwise when viewed from the left. The rotation of the right pinion gear 39 is transferred to the pinion gear 40, rotating the pinion gear 40 and the rotating support part 27 clockwise in a left side view. Through the rotation of the rotating support part 27, the opening member 26 is moved from the second position to the first position.

Similarly, when an opening member 26 is moved from the first position to the second position, the rotating support part 27 and pinion gear 40 rotate counterclockwise in a left side view. The rotation of the pinion gear 40 is transferred to the right pinion gear 39, rotating the right pinion gear 39, rotating support part 33, and left pinion gear 38 clockwise in a left side view. The rotation of the rotating support part 33 moves the closing member 32 from the fourth position to the third position.

Accordingly, the opening member 26 moves from the second position to the first position in association with movement of the closing member 32 from the third position to the fourth position. Similarly, the closing member 32 moves from the fourth position to the third position in association with movement of the opening member 26 from the first position to the second position.

(5) Developing Unit Frame

As shown in FIGS. 3 and 7, the developing unit frames 8 are disposed at regular intervals in the front-to-rear direction and span between the side plates 22 and 23. The developing unit frames 8 define the spaces 12 provided for mounting the toner boxes 11.

Figure 8:
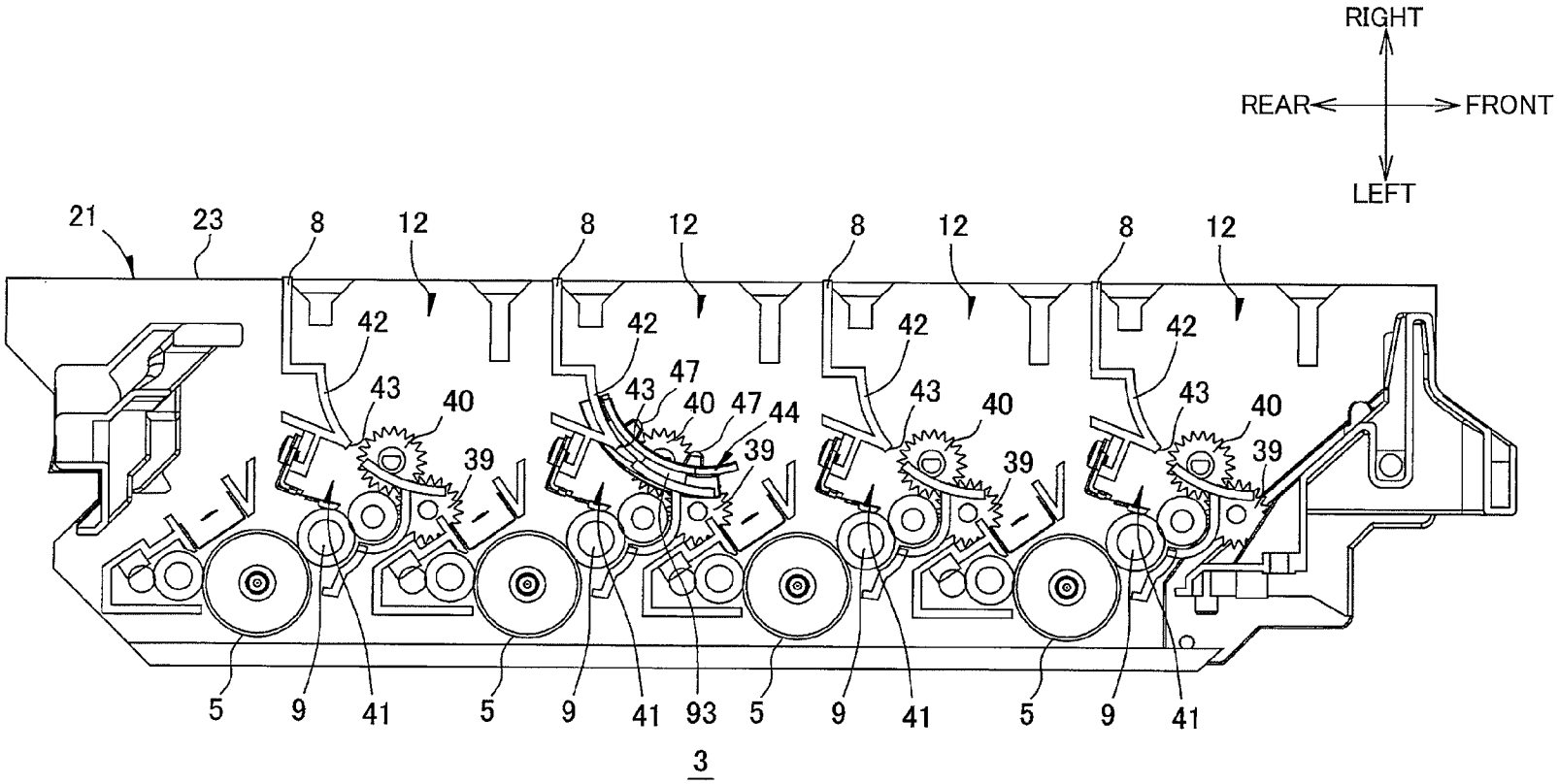
FIG. 8 is a cross-sectional view of the drawer unit taken along the cross-sectional line VIII-VIII shown in FIG. 7.

As shown in FIG. 8, a developing chamber 41 is formed in each developing unit frame 8 for accommodating the developing roller 9. The side of the developing chamber 41 opposing the corresponding photosensitive drum 5 is open. The developing roller 9 is disposed in the bottom of the developing chamber 41 near the open side thereof.

The developing unit frame 8 also has a plate-shaped partitioning wall 42 positioned between the developing chamber 41 and the space 12. The partitioning wall 42 curves in an arc shape with its convex side facing the developing chamber 41. The partitioning wall 42 partitions the interior of the developing unit frame 8 into the developing chamber 41 and the space 12 formed above the developing chamber 41. As shown in FIG. 3, three rectangular openings 43 are formed in the circumferential center of the partitioning wall 42. The rectangular openings 43 are formed at positions opposing three main-body-side communication through-holes 58 (described later with reference to FIG. 12) formed in the toner box 11 when the toner box 11 is mounted in the space 12.

(6) Shutter Drive Member

As shown in FIGS. 7 and 8, a shutter drive member 44 is movably disposed above the partitioning wall 42 for driving a shutter 73 described later.

Figure 9:
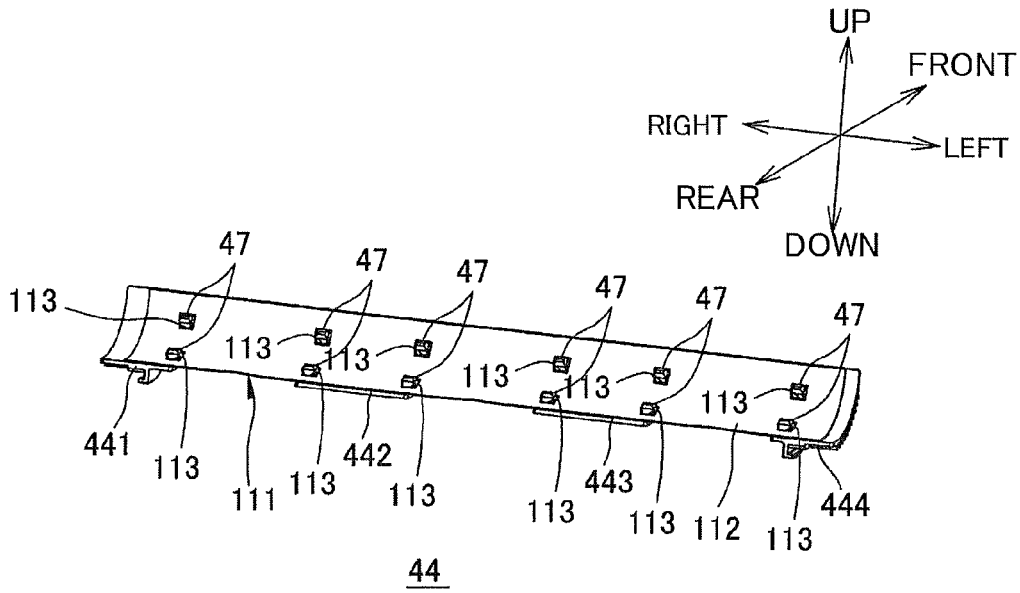
FIG. 9 is a perspective view of a shutter drive member shown in FIG. 8.

As shown in FIG. 9, the shutter drive member 44 includes a main body part 111 (resin plate) formed of a resin, and a reinforcing plate 112 (metal plate) formed of a thin metal plate that is affixed to the main body part 111.

Figure 10:
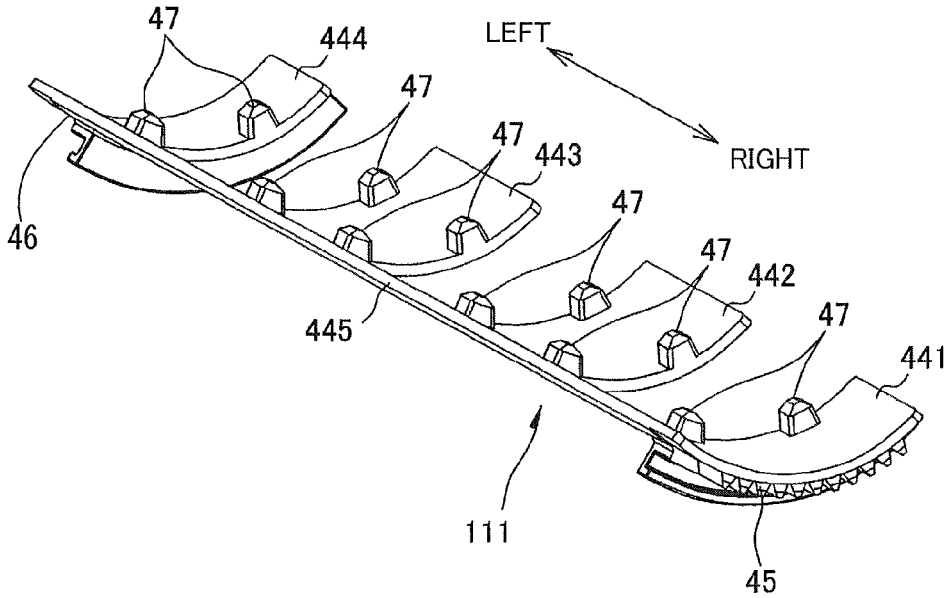
FIG. 10 is a perspective view of a main body part of the shutter drive member shown in FIG. 9.

As shown in FIG. 10, the main body part 111 is integrally configured of four plate-shaped parts 441, 442, 443, and 444 arranged at intervals in the left-to-right direction; and a coupling part 445 having a bar shape that extends in the left-to-right direction for coupling the front edges of the plate-shaped parts 441-444. Each of the plate-shaped parts 441-444 is formed of a plate curved in an arc, with the convex side facing the developing chamber 41. The curved arc of the plate-shaped part substantially conforms to the shape of the partitioning wall 42.

The shutter drive member 44 is provided above the partitioning wall 42 of each developing unit frame 8. For simplification, only the shutter drive member 44 disposed above one partitioning wall 42 is shown in FIGS. 7 and 8.

As shown in FIG. 7, the plate-shaped part 444 on the left end confronts the top of the left pinion gear 38. A left rack gear 46 is formed on the bottom surface of the plate-shaped part 444 (the surface opposing the left pinion gear 38) for engaging with the left pinion gear 38.

As shown in FIG. 7, the plate-shaped part 441 on the right end confronts the top of the right pinion gear 39. More specifically, the pinion gear 40 is engaged in the right end portion of the right pinion gear 39, and the right pinion gear 39 extends farther leftward than the pinion gear 40, as shown in FIG. 6. The plate-shaped part 441 opposes from above the portion of the right pinion gear 39 extending leftward from the pinion gear 40. A right rack gear 45 is formed on the bottom surface of the plate-shaped part 441 opposing the right pinion gear 39 and is engaged with the right pinion gear 39.

When a user operates one of the opening members 26 or closing members 32 to rotate the respective left pinion gear 38 or right pinion gear 39, the rotations of the left pinion gear 38 and right pinion gear 39 are transferred to the left rack gear 46 and right rack gear 45. As a result, the shutter drive member 44 moves between a position opposing the rectangular openings 43 (the position shown in FIG. 7) and a position forward of the rectangular openings 43. More specifically, when one of the opening members 26 is moved from the first position to the second position, the corresponding shutter drive member 44 moves forward from the position opposing the rectangular openings 43 along with the rotations of the left pinion gear 38 and right pinion gear 39 and is placed in a position not opposing the rectangular openings 43.

From this state, if the closing member 32 is moved from the third position to the fourth position, the shutter drive member 44 moves rearward along with the rotations of the left pinion gear 38 and right pinion gear 39 from the position not opposing the rectangular openings 43 to the position opposing the rectangular openings 43.

Shutter drive protrusions 47 are formed on the top surfaces of the plate-shaped parts 441-444 at positions corresponding to shutter drive openings 88 described later.

The reinforcing plate 112 covers the entire region of the main body part 111, excluding the right edge of the plate-shaped part 441 and the left edge of the plate-shaped part 444. Insertion through-holes 113 are formed in the reinforcing plate 112 at positions overlapping the shutter drive protrusions 47. Each of the shutter drive protrusions 47 is inserted through a corresponding insertion through-hole 113 and protrudes upward from the reinforcing plate 112.

By overlaying the reinforcing plate 112 on the main body part 111 in this way, it is possible to ensure sufficient rigidity of the shutter drive member 44 so that the shutter drive member 44 can move the shutter 73 described later with reference to FIG. 12 with sufficient stability.

Further, by inserting the shutter drive protrusions 47 through the insertion through-holes 113 in the reinforcing plate 112, the position of the reinforcing plate 112 relative to the main body part 111 remains fixed with the shutter drive protrusions 47 protruding from the reinforcing plate 112.

Since the three rectangular openings 43 formed in the partitioning wall 42 are opened and closed by the reinforcing plate 112 moving in association with the shutter drive member 44, the reinforcing plate 112 functions as a developing-device-side shutter for opening and closing the rectangular openings 43.

3. Toner Box (1) Main Body

Figure 11:
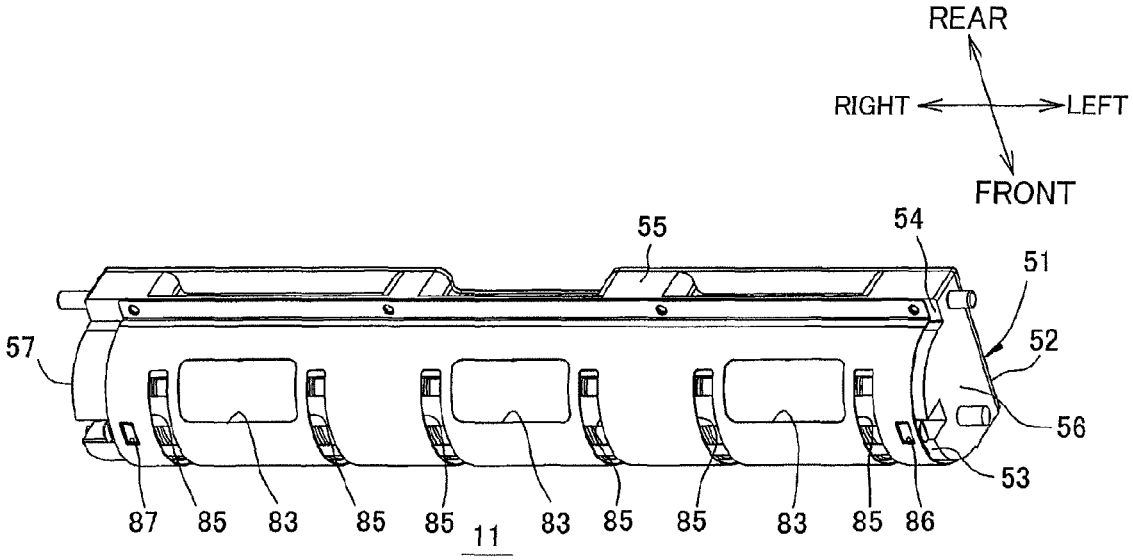
FIG. 11 is a perspective view of one of the toner boxes shown in FIG. 1.
Figure 12:
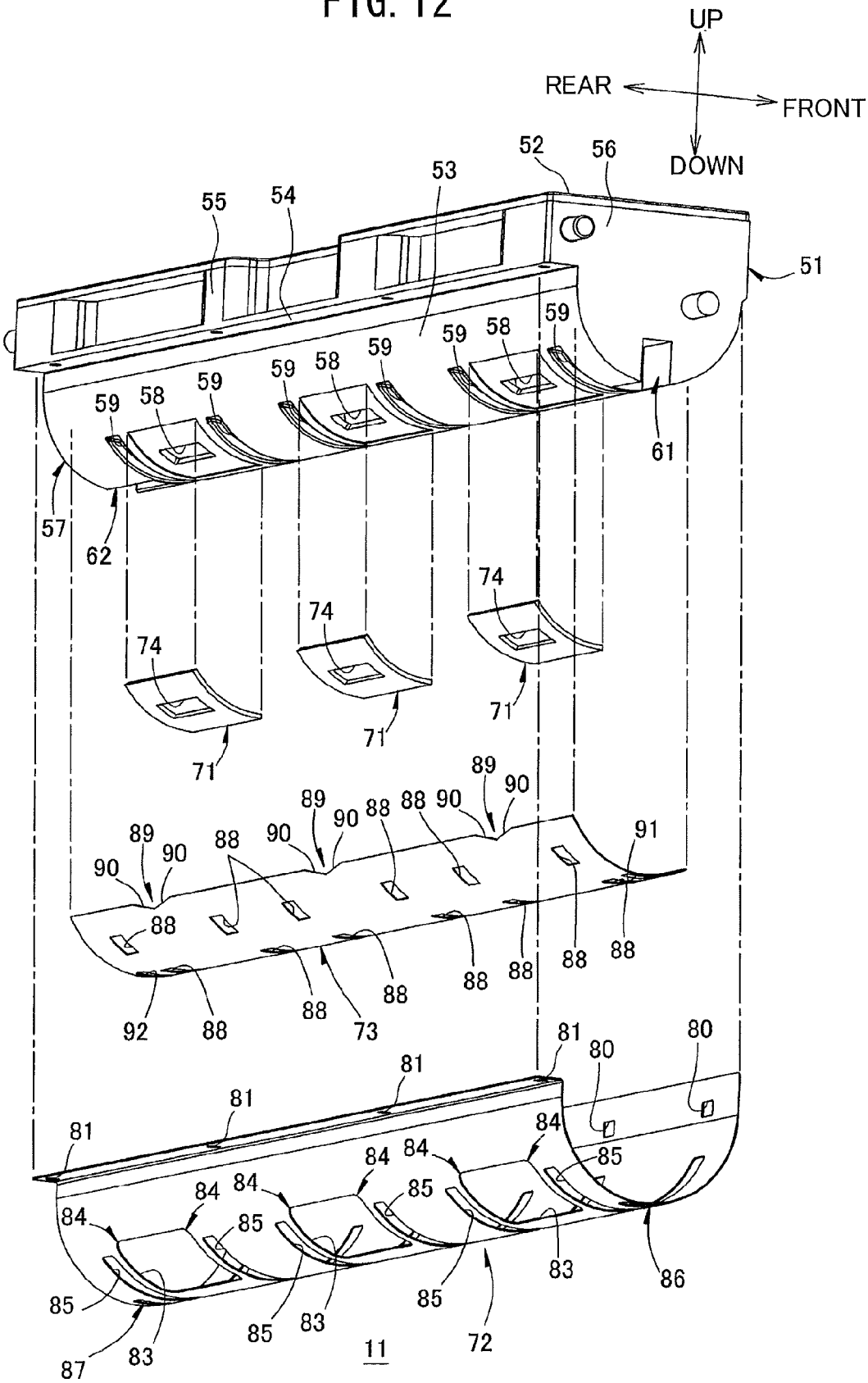
FIG. 12 is an exploded perspective view of the toner box in FIG. 11.

As shown in FIGS. 11 and 12, the toner box 11 includes a main body or toner container 51 for accommodating toner. The main body 51 is formed of a resin material in a substantially hollowed-out semicircular column shape and is elongated in the left-to-right direction. More specifically, the main body 51 has an internal space for accommodating toner that is formed by: a rectangular top surface 52 elongated in the left-to-right direction; an arcing surface 53 that is connected to the front edge of the top surface 52 and that has a substantially semicircular arc shape in a cross section with the convex side facing downward; a fixing surface 54 extending parallel to the top surface 52 and protruding rearward from the rear edge of the arcing surface 53; a rear surface 55 bridging the rear edge of the top surface 52 and the rear edge of the fixing surface 54; a left side surface 56 bridging the respective left edges of the top surface 52, arcing surface 53, fixing surface 54 and rear surface 55; and a right side surface 57 bridging the respective right edges of the top surface 52, arcing surface 53, fixing surface 54, and rear surface 55.

As shown in FIG. 12, three main-body-side communication through-holes (openings) 58 are formed in the arcing surface 53 of the main body 51 at positions slightly rearward of the lowest end thereof. The main-body-side communication through-holes 58 are rectangular in shape and elongated in the left-to-right direction and are spaced at intervals in the left-to-right direction. The main-body-side communication through-holes 58 provide communication between the interior and exterior of the main body 51.

Narrow slit-shaped relief grooves 59 are also formed in the arcing surface 53. The relief grooves 59 extend in the peripheral direction of the arcing surface 53 and are formed one on each of the left and right sides of each main-body-side communication through-hole 58.

Figure 16A:
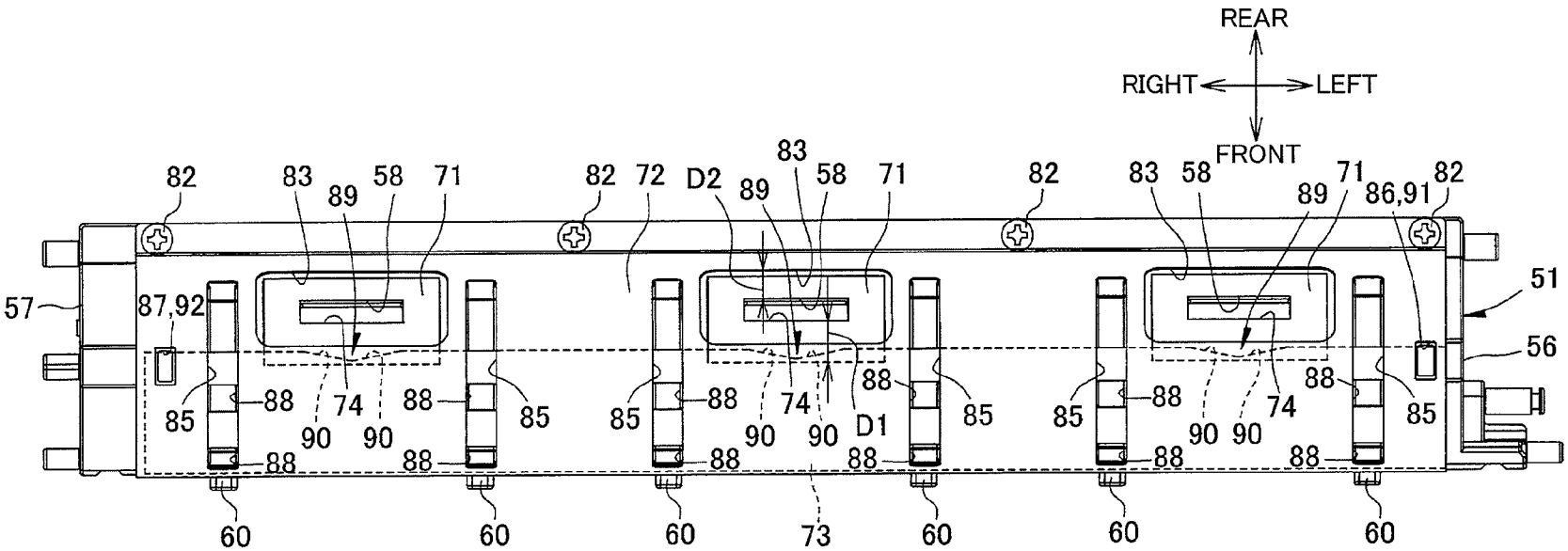
FIG. 16A is a bottom view of the toner box in FIG. 11 when the shutter is in the open position.
Figure 16B:
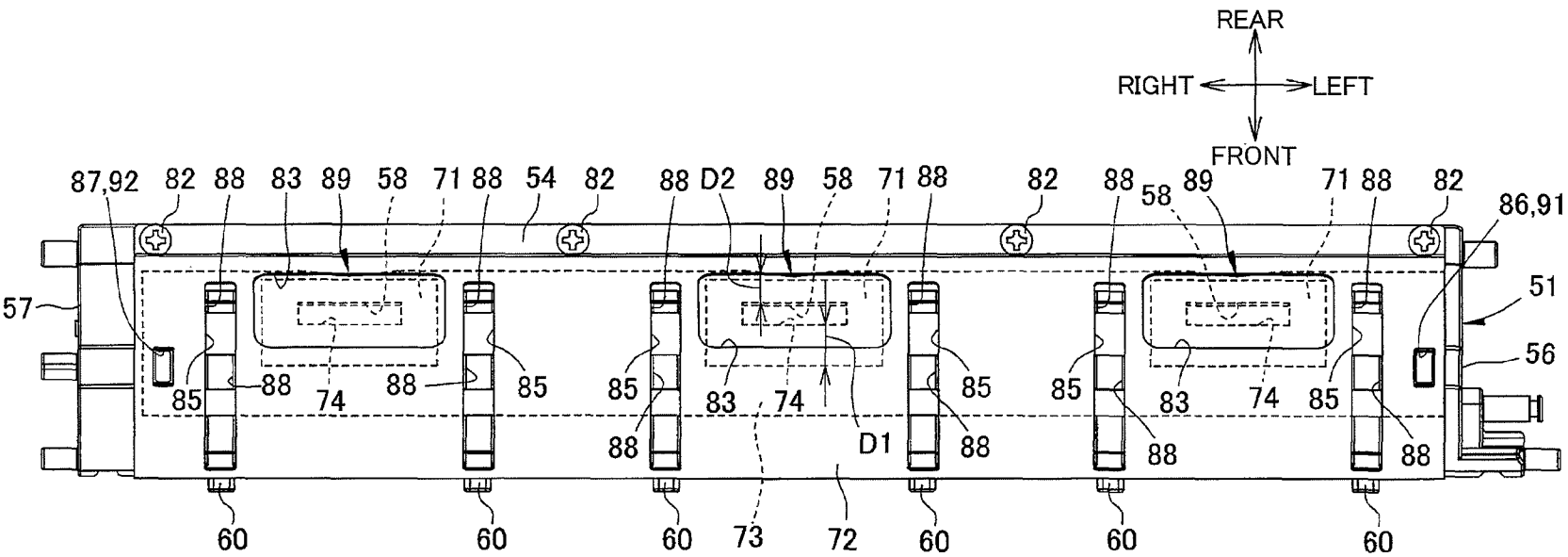
FIG. 16B is a bottom view of the toner box when the shutter is in the closed position.
Figure 17A:
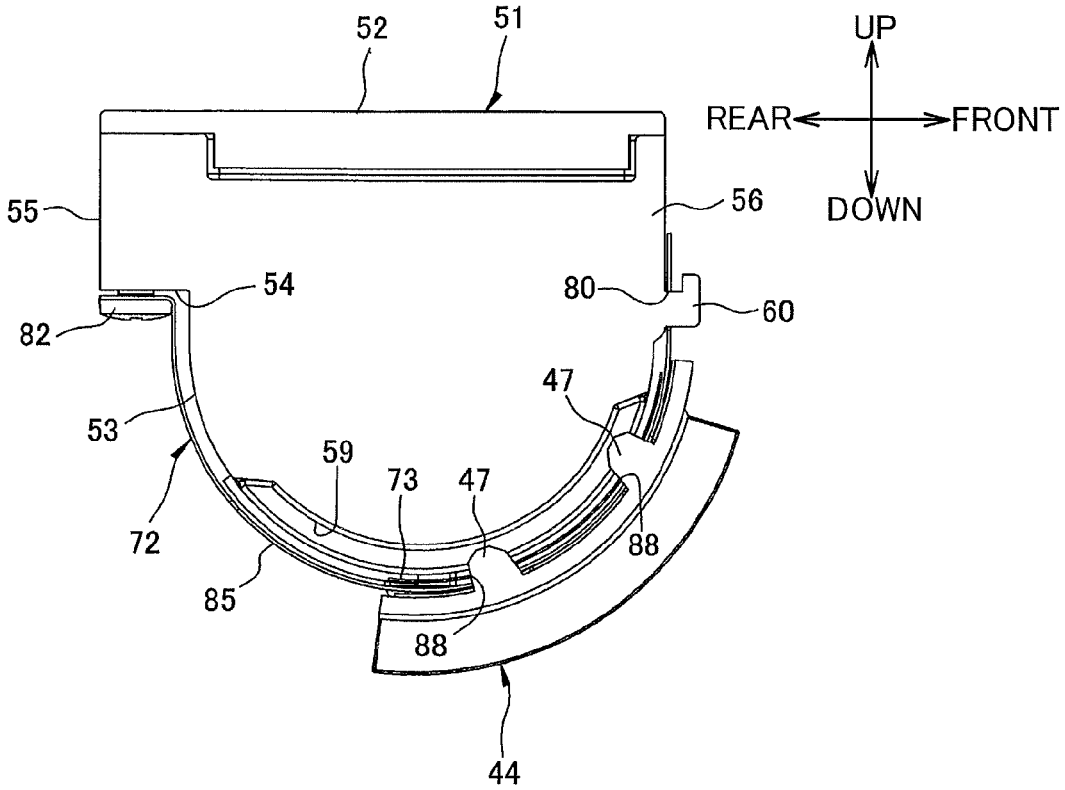
FIG. 17A is a cross-sectional view of the toner box in FIG. 11 and the shutter drive member in FIG. 7 when the shutter is in the open position.
Figure 17B:
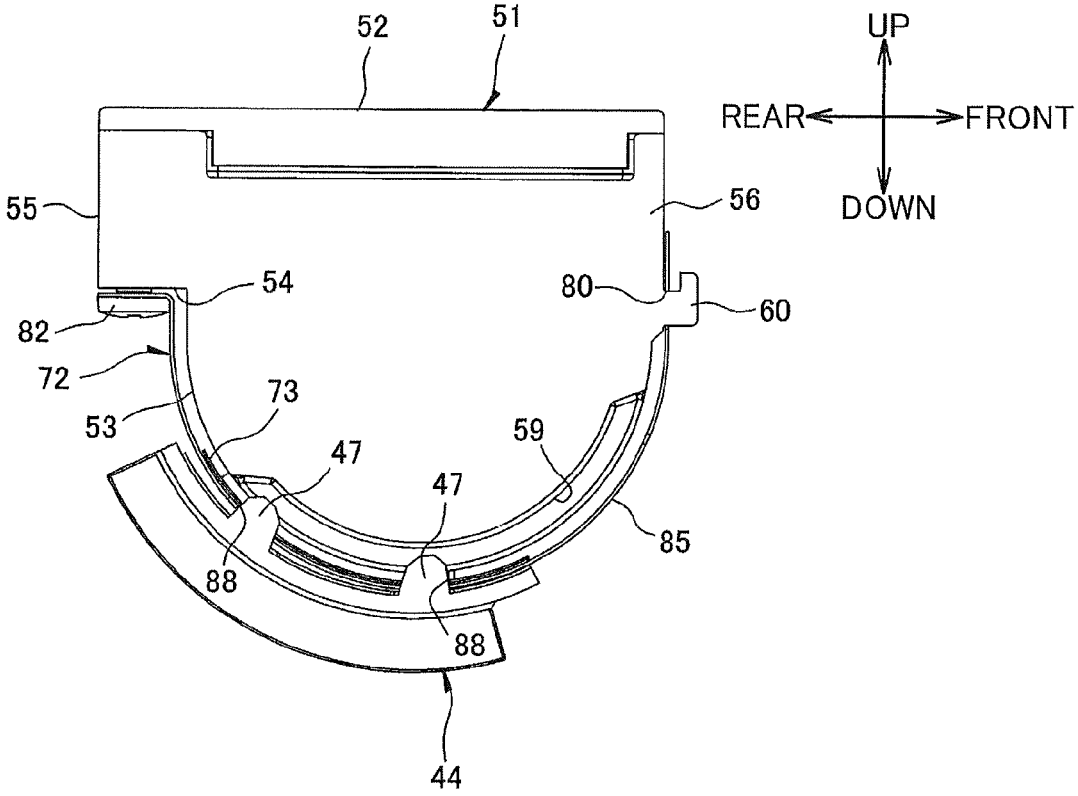
FIG. 17B is a cross-sectional view of the toner box in FIG. 11 and the shutter drive member in FIG. 7 when the shutter is in the closed position.

As shown in FIGS. 16A and 16B, a plurality of positioning protrusions 60 is fanned on the front edge of the arcing surface 53. The positioning protrusions 60 are spaced at intervals in the left-to-right direction. As shown in FIGS. 17A and 17B, each positioning protrusion 60 has a hook shape, extending forward, then bending and extending upward.

As shown in FIG. 12, recessions 61 and 62 are respectively formed in the left and right ends of the main body 51 in the lowest portion of the arcing surface 53. The recession 61 on the left side is open in the left side surface 56 of the main body 51, while the recession 62 on the right side is open in the right side surface 57 of the main body 51.

The toner box 11 further includes toner seals 71 affixed to the arcing surface 53 of the main body 51, a shutter cover 72 disposed so as to cover the arcing surface 53, and a shutter 73 disposed between the arcing surface 53 and shutter cover 72.

(2) Toner Seals

As shown in FIG. 12, one of the toner seals 71 is provided for each main-body-side communication through-hole 58. The toner seal 71 has a sheet-like form and is formed with an opening or through-hole 74 at a position corresponding to the main-body-side communication through-hole 58. The area of the opening 74 is greater than the area of the main-body-side communication through-hole 58. Thus, the toner seals 71 are fixed to the arcing surface 53 of the main body 51 so that the openings 74 are aligned and in communication with the corresponding main-body-side communication through-holes 58 and, hence, encircle the main-body-side communication through-holes 58.

Figure 13:
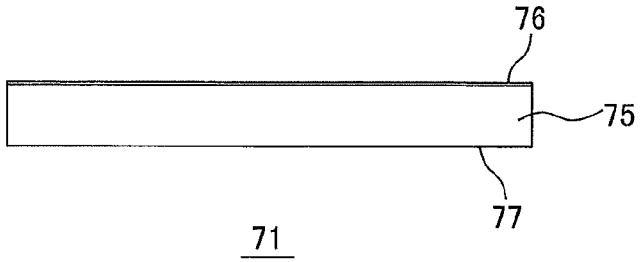
FIG. 13 is a side view of a toner seal shown in FIG. 12.

As shown in FIG. 13, each toner seal 71 has a laminated structure (two-layer structure) configured of an elastic layer 75, and a mesh layer 76 disposed on one surface of the elastic layer 75.

The elastic layer 75 is formed of a resilient foam material, such as the product PORON® (trade name, registered trade mark) manufactured by Rogers Inoac Corporation. The elastic layer 75 is formed much thicker than the mesh layer 76. A fixing surface 77 constituting the surface of the elastic layer 75 opposite the mesh layer 76 is fixed to the arcing surface 53 of the main body 51 with adhesive.

Figure 14:
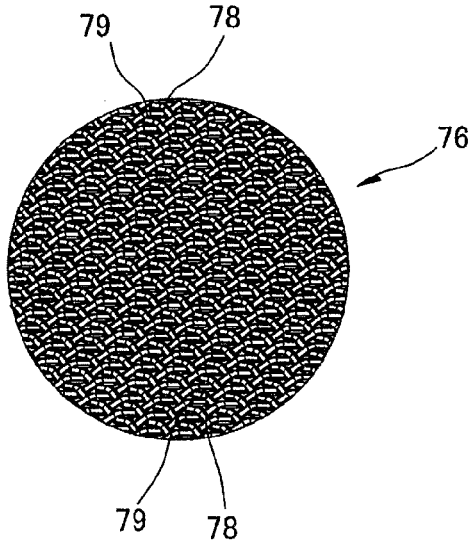
FIG. 14 is a partial perspective view of the surface of a mesh layer shown in FIG. 13.
Figure 15:
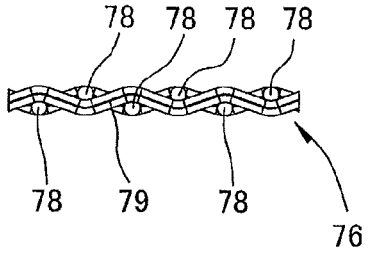
FIG. 15 is a cross-sectional view of the mesh layer.

FIG. 14 shows a surface portion of the mesh layer 76, while FIG. 15 shows a cross-sectional portion of the same. As shown in the drawings, the mesh layer 76 includes warp fibers 78 and weft fibers 79 interlaced in a plain weave (an alternating over and under pattern).

As shown in FIGS. 16A and 16B, the portion of the toner seal 71 disposed forward of the main-body-side communication through-hole 58 (on the front end side of the arcing surface 53) has a width D1 along the circumferential direction of the arcing surface 53. The portion of the toner seal 71 disposed rearward of the main-body-side communication through-hole 58 (on the rear end side of the arcing surface 53) has a width D2 along the circumferential direction of the arcing surface 53. The width D1 is greater than the width D2.

(3) Shutter Cover

The shutter cover 72 is curved to conform to the arcing surface 53 of the main body 51. The shutter cover 72 is formed of a resin film. The shutter cover 72 has a thickness greater than or equal to 0.03 mm and smaller than or equal to 0.3 mm, and preferably greater than or equal to 0.08 mm and smaller than or equal to 0.2 mm. The left-to-right dimension of the shutter cover 72 is approximately equal to the same dimension of the arcing surface 53, so that the shutter cover 72 covers the arcing surface 53 across substantially the entire width in the left-to-right direction.

As shown in FIG. 12, a plurality of positioning openings 80 is formed in the front edge portion of the shutter cover 72 at intervals in the left-to-right direction. As shown in FIGS. 17A and 17B, the positioning protrusions 60 formed on the arcing surface 53 of the main body 51 are engaged in the positioning openings 80. More specifically, the positioning openings 80 are formed in the front edge portion of the shutter cover 72 at positions in the left-to-right direction corresponding to the positioning protrusions 60 and of a sufficient size for inserting the positioning protrusions 60. After the positioning protrusions 60 are inserted into the corresponding positioning openings 80, the top edges of the positioning openings 80 engage the positioning protrusions 60.

The rear edge part of the shutter cover 72 is folded back to conform to the fixing surface 54 of the main body 51. A plurality of screw insertion through-holes 81 are formed in this rear edge portion of the shutter cover 72 at intervals in the left-to-right direction, as shown in FIG. 12. As shown in FIGS. 16A and 16B, the shutter cover 72 is attached to the main body 51 by engaging the positioning protrusions 60 in the respective positioning openings 80, and by inserting screws 82 through all of the screw insertion through-holes 81 and screwing the tips of the screws 82 into the fixing surface 54 of the main body 51.

As shown in FIGS. 11 and 12, cover-side communication through-holes 83 are formed in the shutter cover 72 at positions corresponding to the toner seals 71. Each of the cover-side communication through-holes 83 has a rectangular shape and is elongated in the left-to-right direction. Further, the cover-side communication through-hole 83 has a greater open area than the area of the main-body-side communication through-hole 58 so as to expose the main-body-side communication through-hole 58 in its entirety. The size of each cover-side communication through-hole 83 is such that when the shutter 73 is in an open position (described later), as shown in FIG. 16A, a gap is formed between the rear edge of the corresponding toner seal 71 and the rear edge of the cover-side communication through-hole 83, gaps are formed between the left and right edges of the corresponding toner seal 71 and the left and right edges of the cover-side communication through-hole 83, and the front edge portion of the corresponding toner seal 71 is interposed between the shutter cover 72 and the arcing surface 53 of the main body 51. Consequently, when the shutter 73 is in the open position, the shutter cover 72 does not cover the rear edge and both left and right edges of the toner seal 71, allowing these edges to protrude outward through the cover-side communication through-hole 83.

As shown in FIG. 12, slanted parts 84 having portions angled relative to the circumferential direction of the shutter cover 72 are formed on the shutter cover 72 in both rear side corners of each cover-side communication through-hole 83 as part of the peripheral edge of the cover-side communication through-hole 83. With the slanted parts 84, the left-to-right width of each cover-side communication through-hole 83 grows narrower toward the rear edge of the shutter cover 72.

The part of each slanted part 84 forming a peripheral edge portion of each cover-side communication through-hole 83 may extend in a straight line or follow a gentle curve, provided that the portion is slanted relative to the circumferential direction of the shutter cover 72. These portions of the slanted parts 84 are shaped in a gentle curve in the example of FIG. 12.

Guide slits 85 elongated in the front-to-rear direction (circumferential direction of the shutter cover 72) are formed in the shutter cover 72 at positions corresponding to the relief grooves 59 formed in the main body 51. The guide slits 85 have a front-to-rear length that is greater than or equal to the front-to-rear length of the relief grooves 59. The left-to-right width of the guide slits 85 is also greater than or equal to the left-to-right width of the relief grooves 59. Each guide slit 85 confronts the corresponding relief groove 59 in its entirety.

Locking member insertion through-holes 86 and 87 are also formed in the shutter cover 72 at positions corresponding to the recessions 61 and 62 formed in the main body 51.

(4) Shutter

As shown in FIG. 12, the shutter 73 curves along the arcing surface 53 of the main body 51. The shutter 73 is formed of a resin film having a width in the left-to-right direction slightly smaller than the left-to-right width of the shutter cover 72. The dimension of the shutter 73 along the circumferential direction of the arcing surface 53 is greater than the same dimension of the toner seals 71 and is set such that the shutter 73 does not contact the fixing surface 54 and the positioning protrusions 60 when moving between an open position and a closed position described later.

Two shutter drive openings 88 separated by a prescribed interval in the circumferential direction of the shutter 73 are formed in the shutter 73 at positions opposing each relief groove 59 in the main body 51. The distance between the two shutter drive openings 88 at each position is set such that all shutter drive openings 88 confront a corresponding relief groove 59 and confront and communicate with a corresponding guide slit 85 formed in the shutter cover 72, regardless of whether the shutter 73 is in the open position or the closed position.

V-shaped notches 89 are formed in the rear edge of the shutter 73 (the edge of the shatter 73 on the rear edge side of the arcing surface 53) at positions in the left-to-right direction corresponding to the main-body-side communication through-holes 58 formed in the main body 51. The V-shaped notches 89 open toward the rear edge side of the arcing surface 53. Forming the V-shaped notches 89 in this way, produces sloped parts 90 in the rear edge of the shutter 73 that are angled relative to the circumferential direction of the shutter 73.

Locking openings 91 and 92 are also formed in the shutter 73 at positions opposing the recessions 61 and 62 formed in the main body 51 when the shutter 73 is in the closed position. Hence, when the shutter 73 is in the closed position, the locking openings 91 and 92 confront the recessions 61 and 62, respectively, and also confront the respective locking member insertion through-holes 86 and 87 formed in the shutter cover 72. Accordingly, the recession 61 and locking member insertion through-hole 86 are in communication via the locking opening 91, and the recession 62 and locking member insertion through-hole 87 are in communication via the locking opening 92.

The shutter 73 is interposed between the arcing surface 53 of the main body 51 and the shutter cover 72. While held between the arcing surface 53 and shutter cover 72, the shutter 73 can move between an open position and a closed position described next.

(5) Open Position of the Shutter

In the open position shown in FIG. 16A, the shutter 73 is positioned on the front side of the cover-side communication through-holes 83 formed in the shutter cover 72. More specifically, when the shutter 73 is in the open position, the rear edge of the shutter 73 is positioned farther forward than the front edges of the cover-side communication through-holes 83, and the rear edge portion of the shutter 73 is interposed between the front edge portion of the toner seal 71 and the shutter cover 72. Therefore, each main-body-side communication through-hole 58 formed in the main body 51 and the opening 74 formed in the corresponding toner seal 71 are made open, while being in communication with each other. This provides communication between the interior and exterior of the main body 51. Further, since the rear edge and both left and right edges of the toner seal 71 are exposed, these edges protrude outward through the cover-side communication through-hole 83.

(6) Closed Position of the Shutter

In the closed position shown in FIG. 16B, the shutter 73 is positioned farther rearward than the open position. When the shutter 73 is in the closed position, the rear edge of the shutter 73 is positioned slightly rearward than the rear edges of the cover-side communication through-holes 83. Accordingly, the shutter 73 opposes nearly the entire area of the cover-side communication through-holes 83, excluding the regions opposite part of the V-shaped notches 89 formed in the shutter 73. The toner seals 71 are entirely interposed between the shutter 73 and the arcing surface 53 of the main body 51. As a result, the shutter 73 covers the main-body-side communication through-holes 58 formed in the main body 51 and the openings 74 formed in the toner seals 71 in their entirety, blocking communication between the interior and exterior of the main body 51.

4. Mounting the Toner Box

Each toner box 11 is mounted in or removed from the corresponding space 12 formed above the partitioning wall 42 of the developing unit frame 8 (see FIG. 7) when the corresponding shutter 73 is in the closed position.

When a toner box 11 is not mounted in the corresponding space 12, the opening member 26 is in the first position shown in FIG. 5A and the closing member 32 is in the fourth position shown in FIG. 5B. The corresponding shutter drive member 44 above the partitioning wall 42 is positioned opposite the rectangular openings 43 formed in the partitioning wall 42, as shown in FIGS. 7 and 8.

With the drawer unit 3 (drawer frame 21) pulled out of the main casing 2 to the pull-out position (see FIG. 1), the toner box 11 is mounted into the corresponding space 12 from above. More specifically, when the drawer unit 3 is at the pull-out position, the spaces 12 and the operation members (opening members 26 and closing members 32) for all the four colors are located outside of the main casing 2. So, the toner boxes 11 for all the four colors can be mounted to and detached from the drawer unit 3. For each color, one of the opening member 26 or the closing members 32 that protrudes downwardly from the corresponding cover 31 or 37 can be accessed and manipulated by the user. At this time, the shutter drive protrusions 47 positioned closer to the front side among the pairs of shutter drive protrusions 47 formed in the shutter drive member 44 protrude upward along a substantially vertical direction, while the shutter drive protrusions 47 positioned closer to the rear protrude in a direction angled upward and forward, as shown in FIG. 17B. When the toner box 11 is mounted in the space 12, each of the shutter drive protrusions 47 engages in a corresponding shutter drive opening 88 through the corresponding guide slit 85.

While the drawer unit 3 remains in the pull-out position, an operator next moves the opening member 26 from the first position shown in FIG. 5A to the second position shown in FIG. 4A, causing the shutter drive member 44 to move from a position confronting the rectangular openings 43 to a position not confronting the rectangular openings 43 (see FIG. 17A). In association with the movement of the shutter drive member 44, the shutter 73 moves forward from the closed position to the open position.

As shown in FIG. 8, annular frame seals 93 are disposed on top of the partitioning wall 42 at positions corresponding to each of the toner seals 71. That is, the annular frame seals 93 are disposed on a surface of the partitioning wall 42 confronting the corresponding space 12 at positions corresponding to each of the toner seals 71. The annular frame seals 93 surround the periphery or perimeter of each rectangular opening 43. When the shutter 73 is in the open position, the rear edge and both left and right edges of each toner seal 71 protrudes outward through the corresponding cover-side communication through-hole 83. The protruding portions of the toner seal 71 directly press against the corresponding frame seal 93, and portions of the frame seal 93 that do not contact the toner seal 71 contact the shutter cover 72. Therefore, the opening 74 formed in each toner seal 71 is in communication with the corresponding rectangular opening 43 through the opening region in the corresponding frame seal 93, while the toner seal 71 and frame seal 93 seal any gaps formed between the partitioning wall 42 and shutter cover 72.

After all toner boxes 11 have been mounted in the corresponding spaces 12, all opening members 26 have been shifted from their first positions to their second positions, and the shutters 73 of all toner boxes 11 are in their open positions, the toner boxes 11 supply toner to all corresponding developing units 7. Subsequently, the operator pushes the drawer unit 3 to the accommodated position within the main casing 2 and closes the front cover 4 (see FIG. 1). At this time, the user can begin performing image-forming operations with the color printer 1.

In order to remove a toner box 11 from the drawer unit 3, the operator opens the front cover 4 and pulls the drawer unit 3 outward from the accommodated position to the pull-out position. Next, the operator shifts the closing member 32 for the desired toner box 11 from the third position shown in FIG. 4B to the fourth position shown in FIG. 5B. This movement of the closing member 32 moves the shutter drive member 44 from a position not confronting the rectangular openings 43 to a position confronting the rectangular openings 43 (see FIG. 17B). In association with the movement of the shutter drive member 44, the shutter 73 moves rearward from the open position to the closed position.

Next, the operator removes the toner box 11 from the space 12. Since the shutter 73 is in the closed position at this time, there is no risk of toner spilling out of the main body 51 when the toner box 11 is removed.

5. Locking Mechanism

Since the shutter drive protrusions 47 are not engaged in the shutter drive openings 88 when the toner box 11 has been removed from the drawer unit 3, the shutter 73 can move freely relative to the main body 51 and shutter cover 72. Therefore, if the toner box 11 were jolted, shaken, or the like, the shutter 73 could move out of the closed position.

Figure 18A:
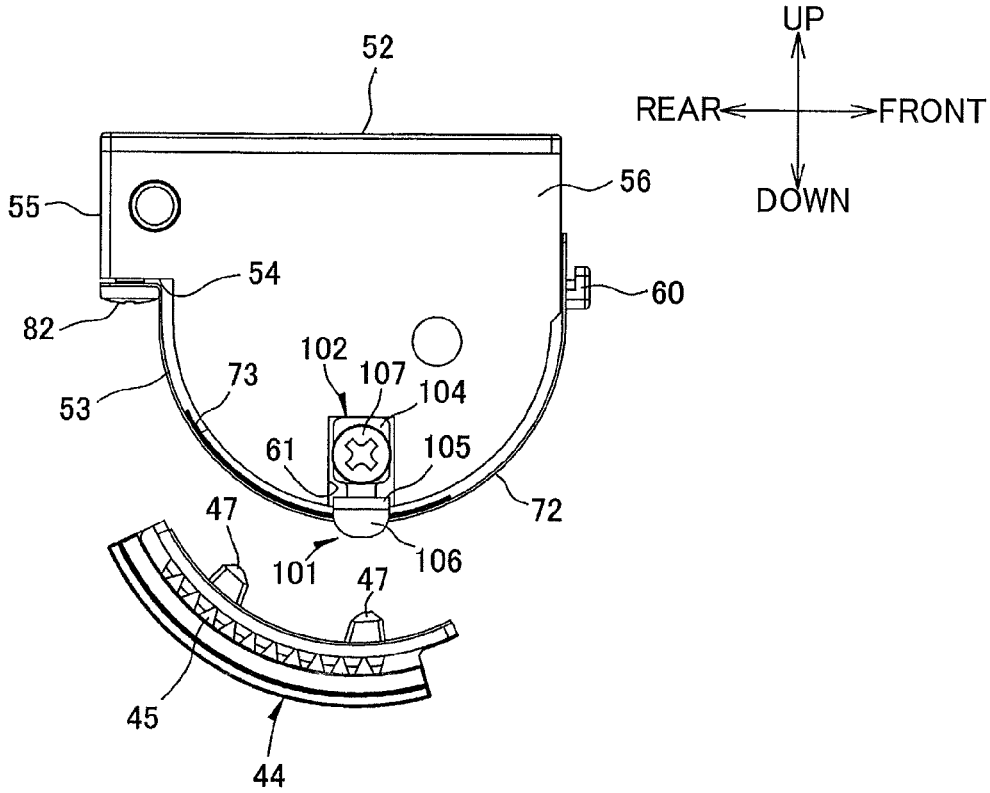
FIG. 18A is a left side view of the toner box in FIG. 11 and the shutter drive member in FIG. 7 showing the state of a locking mechanism before the toner box has been coupled with the shutter drive member.
Figure 18B:
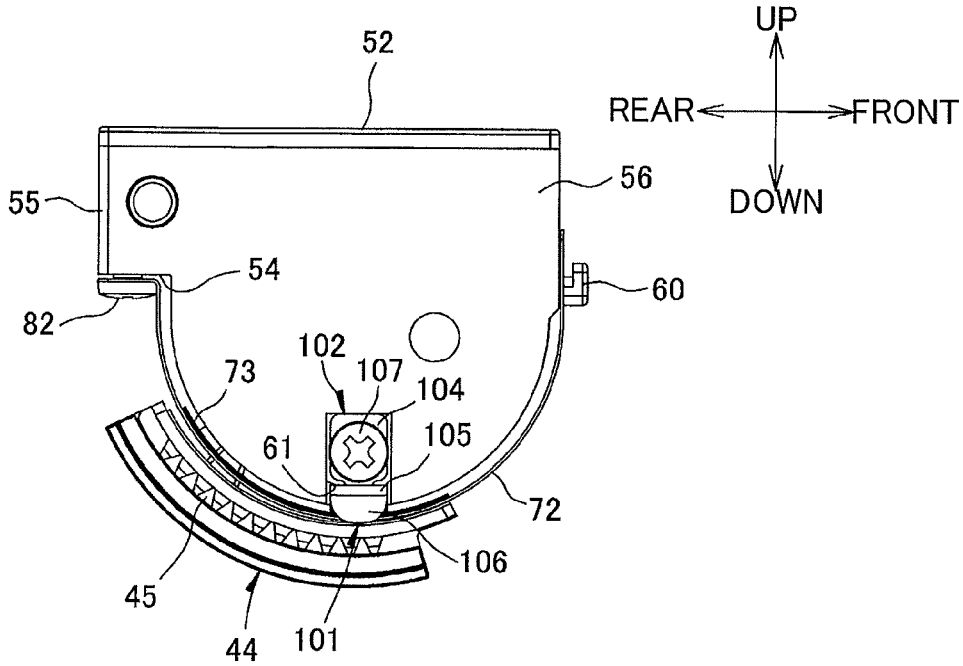
FIG. 18B is a left side view of the toner box in FIG. 11 and the shutter drive member in FIG. 7 showing the state of the locking mechanism after the toner box has been coupled with the shutter drive member.

In order to fix the shutter 73 in the closed position while the toner box 11 is removed from the drawer unit 3, the toner box 11 in the embodiment has a locking mechanism 101 provided in each of the recessions 61 and 62, as shown in FIGS. 18A and 18B. Since the locking mechanism 101 disposed in the recession 61 and the locking mechanism 101 disposed in the recession 62 have the same structure, except in mirror image, the locking mechanism 101 disposed in the recession 61 will be used below for a collective description of the locking mechanisms 101.

Figure 19:
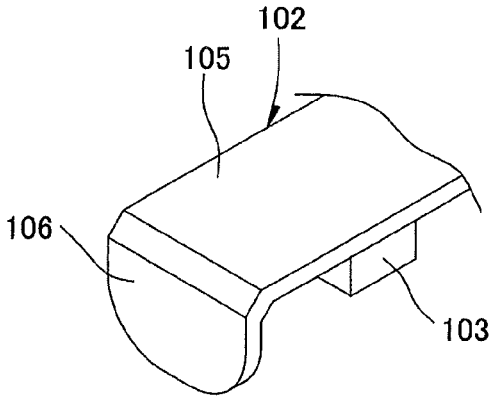
FIG. 19 is a partial perspective view of the locking mechanism shown in FIGS. 18A and 18B.

As shown in FIG. 19, the locking mechanism 101 includes an arm 102, and a locking protrusion 103 attached to the arm 102.

The arm 102 is configured of a flexible thin plate, such as a leaf spring. The arm 102 has the shape of a crank. That is, beginning from one end, the arm 102 extends downward within the recession 61, then bends and extends leftward, and finally bends and extends downward. More specifically, as shown in FIGS. 18A and 18B, the arm 102 is integrally formed of a fixing part 104 extending downward within the recession 61, a holding part 105 extending leftward from the bottom edge of the fixing part 104, and a contact part 106 extending downward from the left edge of the holding part 105. The fixing part 104 is fixed to the leftward-facing surface of the main body 51 inside the recession 61 by a screw 107.

As shown in FIG. 19, the locking protrusion 103 has a flattened square pillar shape and is fixed to the bottom surface of the holding part 105. When the shutter 73 is in the closed position, the locking protrusion 103 on the bottom surface of the holding part 105 is disposed in a position opposing the locking opening 91 formed in the shutter 73.

Figure 20A:
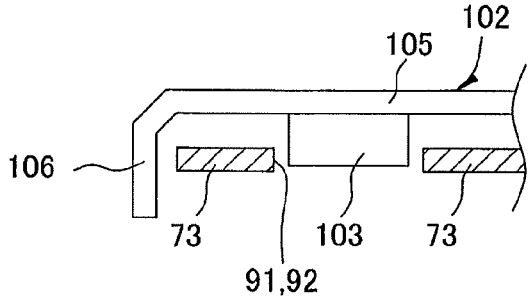
FIG. 20A is a cross-sectional view of the shutter and locking mechanism when the shutter is fixed by the locking mechanism.

Accordingly, when the toner box 11 has been removed from the drawer unit 3, the locking protrusions 103 of both locking mechanisms 101 are respectively inserted into the locking openings 91 and 92 formed in the shutter 73, as shown in FIGS. 18A and 20A, thereby preventing the shutter 73 from moving out of the closed position. Accordingly, the locking mechanisms 101 prevent the shutter 73 from moving out of the closed position while the toner box 11 has been removed from the drawer unit 3.

Figure 20B:
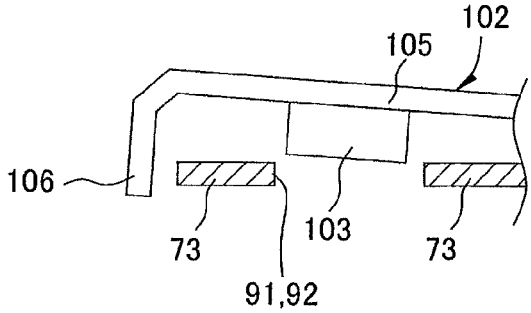
FIG. 20B is a cross-sectional view of the shutter and locking mechanism when the shutter is not fixed by the locking mechanism.

When the toner box 11 is mounted in a corresponding space 12 provided in the drawer unit 3, the bottom edge of the contact part 106 contacts the top surface of the shutter drive member 44 (the top surface of the plate-shaped part 441 or 444) during the mounting operation, as shown in FIGS. 18B and 20B. Thus, as the toner box 11 is moved farther in the mounting direction, the force of resistance received from the shutter drive member 44 causes the holding part 105 of the arm 102 to deform, bending so that the left end of the holding part 105 rises upward. Consequently, the locking protrusions 103 are extracted from the locking openings 91 and 92. At this time, the shutter 73 can move freely relative to the main body 51 and shutter cover 72 and can move together with the shutter drive member 44.

6. Operations (1) According to the above described embodiment, the drawer unit 3 (drawer frame 21) is movable between the accommodated position in the main body casing 2 and the pull-out position, in which the drawer unit 3 is partly outside the main body casing 2, but is still partly mounted on the main casing 2. The plurality of photosensitive drums 5 are held in the drawer frame 21 and are spacedly arrayed side by side in the frontward/rearward direction which is the moving direction of the drawer unit 3. Further, the plurality of developing units 7 each corresponding to each photosensitive drum 5 are also held in the drawer frame 21. Further, the plurality of toner boxes 11 is held in the drawer frame 21. Each toner box 11 is provided for each developing unit 7 and is detachably attached to the drawer frame 21 positioned at the pull-out position.

The toner box 11 includes the main body or toner container 51 accommodating toner therein, and the toner container 51 is formed with the openings (main-body-side communication through-holes) 58 for supplying toner to the developing unit 7. Further, the toner box 11 is provided with the shutter 73 movable between open position and closed position for opening and closing the openings 58.

The drawer frame 21 is provided with the opening member 26 and the closing member 32 to be operated for moving the shutter 73 between its open position and closed position. The opening member 26 and the closing member 32 are not provided at a position above each toner box 11, but are positioned at the drawer frame 21. Therefore, the opening member 26 and the closing member 32 can be manipulated for moving the shutter 73 at a position close to the center of gravity of the color printer 1, when the drawer unit 3 is at the pull-out position. Thus, overturning of the color printer 1 during manipulation to the opening member 26 and the closing member 32 can be prevented.

Now assume a comparative example where the closing members and the opening members are provided in upper portions of the toner box. In such a comparative example, the color printer will possibly be overturned. That is, after the drawer unit is pulled out from the main casing, a center of gravity of the color printer is displaced toward the pull-out side of the drawer unit. In this state, the operation to the closing members and opening members will possibly impart a force on the drawer unit, thereby generating rotational moment to the printer. Contrarily, according to the present embodiment, the closing members and the opening members are provided to the drawer unit. So, the closing members and opening members can be manipulated at positions closer to the center of gravity of the color printer 1, compared to the case where the closing members and opening members are provided in the upper portions of the toner boxes.

(2) Further, the opening member 26 and the closing member 32 are separating components from each other, and therefore, a degree of freedom for the design of the opening member 26 and closing member 32 can be increased in comparison with a case where a single or common operation member performs movement of the shutter 73 between the opening and closing positions. Consequently, more accurate attention can be drawn to the design of the opening member 26 and the closing member 32 so as to further avoid load application that causes overturning of the color printer 1 during manipulation to the opening member 26 and closing member 32. As a result, overturning of the color printer 1 can further be prevented.

(3) The opening member 26 is moved upward from its first position to the second position for moving the shutter 73 from its closed position to the open position. Further, the closing member 32 is moved upward from its third position to the fourth position for moving the shutter 73 from its open position to the closed position. The upward movement of the operation members 26, 32 does not apply downward load to the drawer frame 21. Prevention of the overturning of the color printer 1 is attributed to the provision of the operation members 26, 32 to the drawer frame 21.

(4) The drawer frame 21 includes the pair of side plates 22, 23 extending in the moving direction thereof. The pair of side plates 22, 23 are spaced away from each other so as to provide the space 12 for the accommodation of the toner box 11. The opening member 26 and closing member 32 are positioned externally of the side plates 22, 23, i.e., opposite to the space 12 with respect to the side plates 22, 23, thereby improving operability to these operation members.

(5) More specifically, the opening member 26 is positioned at the outer side of the right side plate 22, and the closing member 32 is positioned at the outer side of the left side plate 23. Therefore, the opening member 26 and closing member 32 can be easily distinguished from each other because of their layout. Thus, operability to these operation members can further be enhanced.

(6) The drawer unit 3 is provided with the shutter drive member 44 that is connectable with the shutter 73 to move the shutter 73 between the open position and the closed position. The shutter drive member 44 is connected to the operation members 26, 32. Thus, the shutter driving member 44 can be moved upon operation of the operation members 26, 32, to thereby move the shutter 73 between the open position and closed position. More specifically, each developing unit 7 is provided with the shutter driving member 44 for moving the shutter 73 between the open position and the closed position. Each shutter driving member 44 extends in the confronting direction of the pair of side plates 22, 23, and has one end portion connected with the opening member 26 and other end portion connected with the closing member 32. Thus, the shutter driving member 44 can be moved upon operation of the opening member 26 and closing member 32 to move the shutter 73 between the open position and closed position.

(7) The opening member 26 and closing member 32 are pivotally movable. Thus, the opening member 26 can be moved from the first position to the second position by its pivotal motion, and the closing member 32 can be moved from the third position to the fourth position by its pivotal motion.

(8) Pivotally moving direction of the opening member 26 from the first position to the second position is opposite to pivotally moving direction of the closing member 32 from the third position to the fourth position when viewing the operation members 26, 32 from each external side of each of the opening member 26 and the closing member 32. In other words, pivotally moving direction of the opening member 26 from the first position to the second position is coincident with the pivotally moving direction of the closing member 32 from the third position to the fourth position when viewing these operation members 26, 32 from one fixed external side of one of the opening member 26 and the closing member 32. Therefore, the shutter 73 can be moved from the closed position to the open position and from the open position to the closed position by pivotally moving the operation members 26, 32 in the same direction.

(9) Each of the opening member 26 and closing member 32 has the rotating support part 27, 33 and the lever part 28, 34 extending from the rotating support part frontward (in the direction from the accommodated position to the pull-out position). Because each lever part 28, 34 is positioned frontward of the rotating support part 27, 33, i.e., at the near side when the drawer unit 3 is to be pulled out. Therefore, these lever parts 28, 34 are easily accessible to enhance operability to these lever parts.

(10) The lever part 28 of the opening member 26 and the lever part 34 of the closing member 32 extend in the horizontal direction when these are positioned at the second position and fourth position, respectively. That is, the lever part 28 of the opening member 26 extends horizontally when the shutter 73 is open, and the lever part 34 of the closing member 32 extends horizontally when the shutter 73 is closed. Therefore, open position and closed position of the shutter 73 can be easily recognized by the posture of these lever parts 28, 34.

(11) Further, the first cover 31 and second cover 37 are provided for covering the opening member 26 at its second position and the closing member 32 at its fourth position, respectively. Therefore, access to these operation members 26, 32 at their second and fourth positions, respectively can be prevented.

Incidentally, the first cover 31 and the second cover 37 need not be positioned above the operation members 26, 32, but can be positioned spaced away from the side plates 22, 23 of the drawer frame 21 interposing the opening member 26 between the side plate 23 and the first cover 31, and interposing the closing member 32 between the side plate 22 and the second cover 37. In the latter case, a gap between the side plate 23 and the first cover 31 and a gap between the side plate 22 and the second cover 37 must be a size that prohibits access to the operation members 26, 32 at their second and fourth positions.

(12) Further, four opening members 26 are collectively covered by the single first cover 31, and four closing members 32 are collectively covered by the single second cover 37, thereby reducing the numbers of parts and components in comparison with a case where each opening member 26 and each closing member 32 is covered by each cover. Thus, simplified and low cost device can be provided.

(13) The closing member 32 is moved from the fourth position to the third position in interlocking relation to the movement of the opening member 26 from the first position to the second position. Further, the opening member 26 is moved from the second position to the first position in interlocking relation to the movement of the closing member 32 from the third position to the fourth position. Therefore, it is ensured that the opening member 26 is positioned at the first position when the shutter 73 is to be moved from the closed position to the open position, and that the closing member 32 is positioned at the third position when the shutter 73 is to be moved from the open position to the closed position. Accordingly, enhanced operability to the opening member 26 and closing member 32 can be provided.

7. Modifications

Various modifications are conceivable with respect to the opening member 26, closing member 32 and the interlocking mechanism other than the structure shown in FIG. 6.

(1) First Modification

Figure 21A:
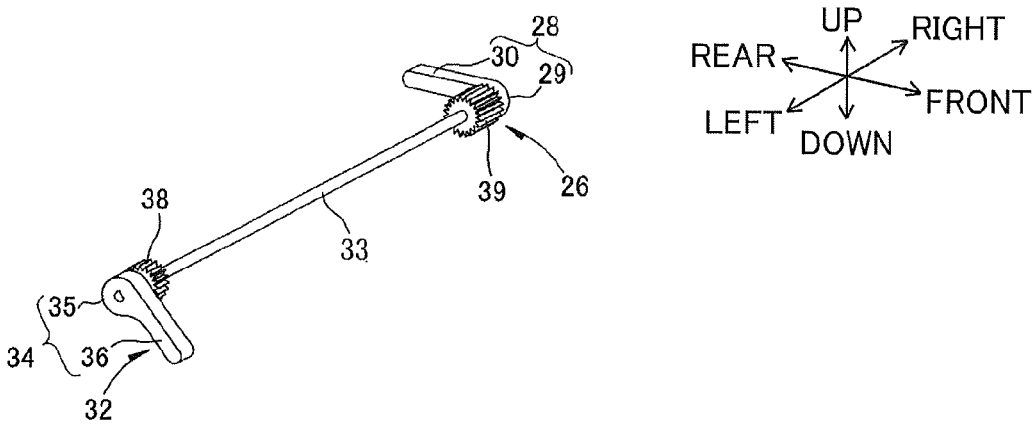
FIG. 21A is a perspective view of the opening member, closing member and their interlocking mechanism according to a first modification and showing a state where the opening member is at a second position and the closing member is at a third position.
Figure 21B:
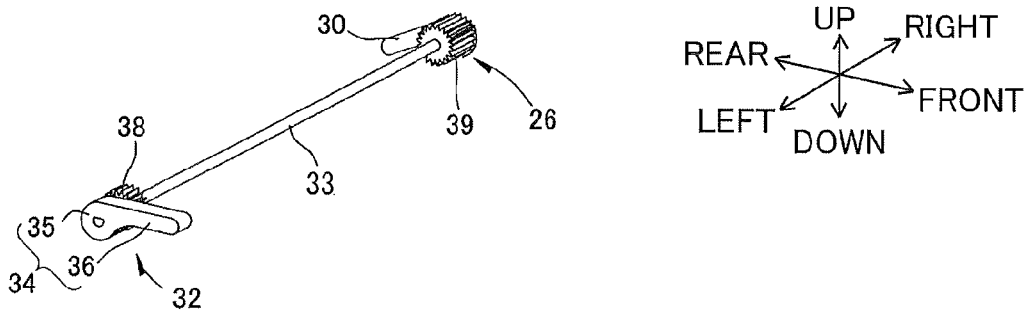
FIG. 21B is a perspective view of the opening member, the closing member and their interlocking mechanism according to the first modification and showing a state where the opening member is at a first position and the closing member is at a fourth position.

As shown in FIGS. 21A and 21B, the rotating support part of the opening member 26 can be commonly used for the rotating support part of the closing member 32. That is, the rotating support part 33 can be used as rotating support parts for both of the operation members 26 and 32. In other words, both of the lever parts 28 and 34 are coupled to the rotating support part 33. The gear 40 and the rotating support part 27 are omitted. In this case, the opening member 26 is coupled to the rotating support part 33 such that the lever part 28 extends rearward. Further, the aim part 30 is oriented diagonally downward when the opening member 26 is at the first position shown in FIG. 21B, and is oriented horizontally when the opening member 26 is at the second position shown in FIG. 21A. On the other hand, the closing member 32 is coupled to the rotating support part 33 such that the lever part 34 extends frontward. Further, the arm part 36 is oriented horizontally when the closing member 32 is at the fourth position shown in FIG. 21B, and is oriented diagonally downward when the closing member 32 is at the third position shown in FIG. 21A.

With this structure, pivotally moving direction of the opening member 26 from the first position to the second position (counterclockwise direction) is identical to pivotally moving direction of the closing member 32 from the third position to the fourth position (counterclockwise direction) when viewing the operation members 26, 32 from each external side of each of the opening member 26 and the closing member 32. In other words, pivotally moving direction of the opening member 26 from the first position to the second position is opposite to the pivotally moving direction of the closing member 32 from the third position to the fourth position when viewing these operation members 26, 32 from one fixed external side of one of the opening member 26 and the closing member 32. Therefore, the shutter 73 can be moved from the closed position to the open position and from the open position to the closed position by pivotally moving the operation members 26, 32 in opposite directions.

In addition, upward direction is realized when moving the opening member 26 from the first position to the second position and moving the closing member 32 from the third position to the fourth position. The upward movement of the operation members can avoid application of downward load to the drawer unit 3, thereby preventing overturning of the color printer 1.

(2) Second Modification

Figure 22A:
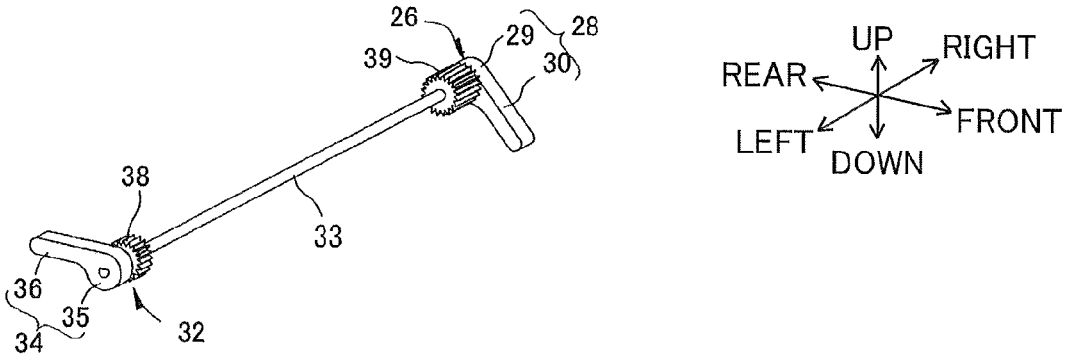
FIG. 22A is a perspective view of the opening member, closing member and their interlocking mechanism according to a second modification and showing a state where the opening member is at a first position and the closing member is at a fourth position.
Figure 22B:
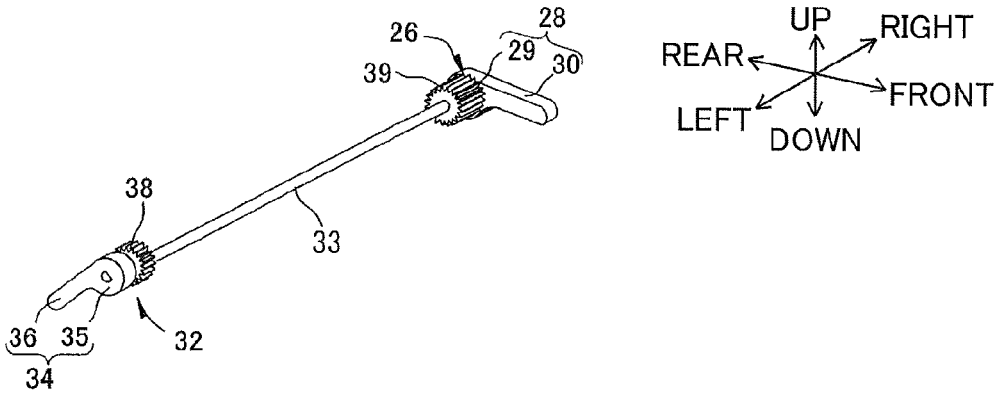
FIG. 22B is a perspective view of the opening member, closing member and their interlocking mechanism according to the second modification and showing a state where the opening member is at a second position and the closing member is at a third position.

The second modification shown in FIGS. 22A and 22B is similar to the first modification in that the opening member 26 and closing member 32 are coupled to the common rotating support part 33. However, in this modification, the closing member 32 is coupled to the rotating support part 33 such that the lever part 34 extends rearward. The arm part 36 of the closing member 32 is oriented diagonally downward at its third position shown in FIG. 22B, and oriented horizontally at its fourth position shown in FIG. 22A. On the other hand, the opening member 26 is coupled to the rotating support part 33 such that the lever part 28 extends frontward. The arm part 30 of the opening member 26 is oriented horizontally at its second position shown in FIG. 22B, and oriented diagonally downward at its first position shown in FIG. 22A.

With this structure, similarly to the first modification, pivotally moving direction of the opening member 26 from the first position to the second position (clockwise direction) is identical to pivotally moving direction of the closing member 32 from the third position to the fourth position (clockwise direction) when viewing the operation members 26, 32 from each external side of each of the opening member 26 and the closing member 32. In other words, pivotally moving direction of the opening member 26 from the first position to the second position is opposite to the pivotally moving direction of the closing member 32 from the third position to the fourth position when viewing these operation members 26, 32 from one fixed external side of one of the opening member 26 and the closing member 32. Therefore, the shutter 73 can be moved from the closed position to the open position and from the open position to the closed position by pivotally moving the operation members 26, 32 in opposite directions.

In addition, upward direction is realized when moving the opening member 26 from the first position to the second position and moving the closing member 32 from the third position to the fourth position. The upward movement of the operation members can avoid application of downward load to the drawer unit 3, thereby preventing overturning of the color printer 1.

(3) Third Modification

In the above-described embodiment, four opening members 26 and four closing members 32 are provided at the drawer unit 3. Instead, according to the third modification, a single opening member 26 and a single closing member 32 are provided at front end portions of the side plates 23, 22, respectively.

Figure 23A:
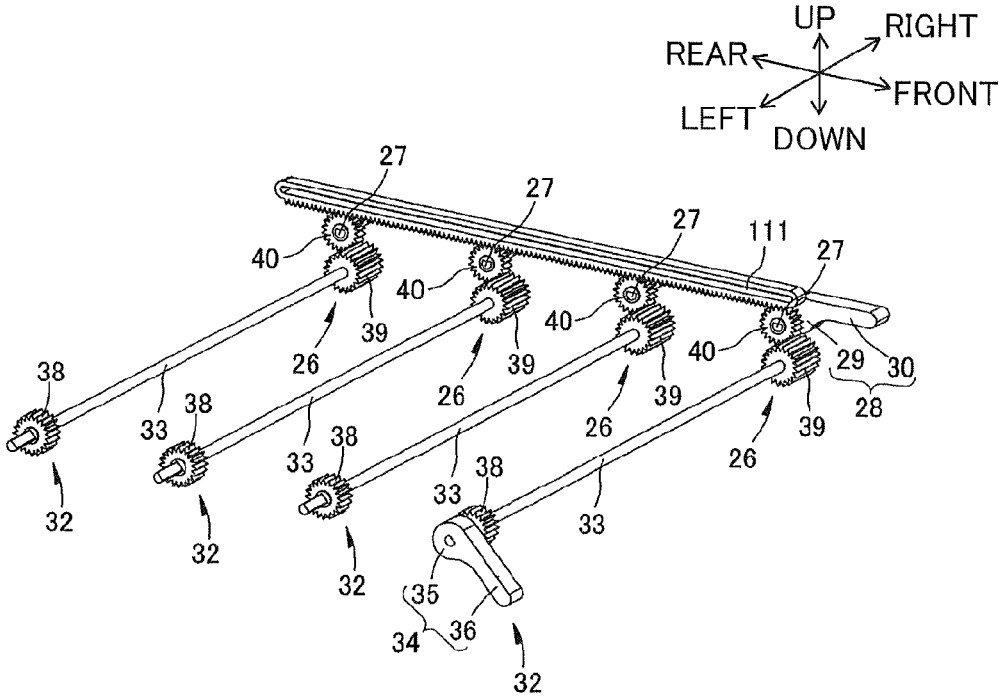
FIG. 23A is a perspective view of the opening member, closing member and their interlocking mechanism according to a third modification and showing a state where the opening member is at a second position and the closing member is at a third position.
Figure 23B:
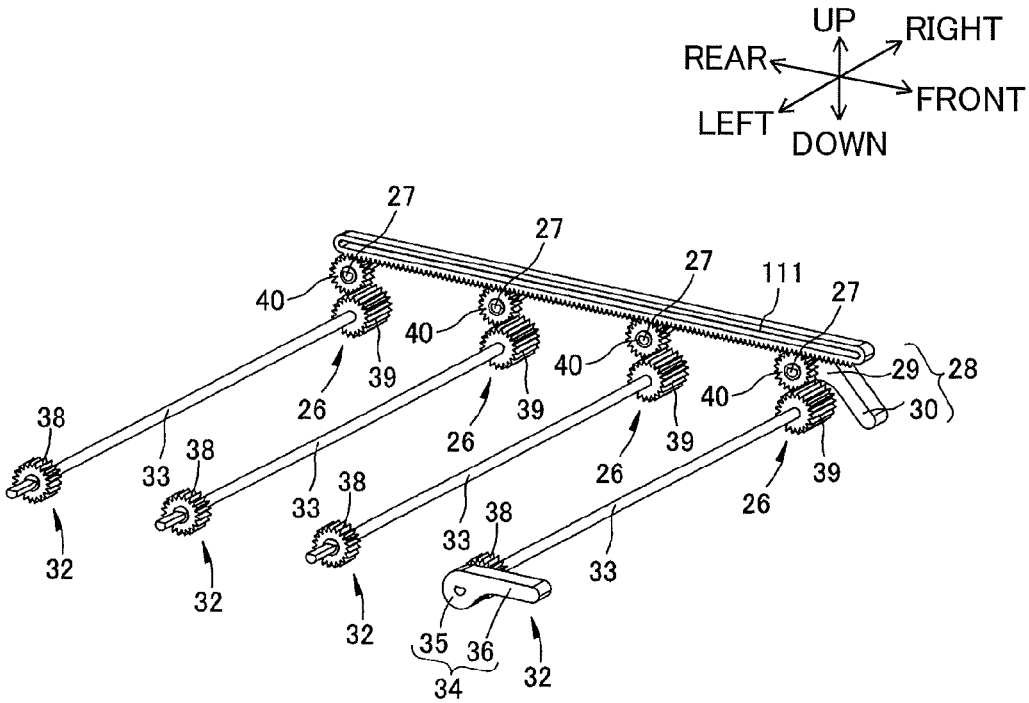
FIG. 23B is a perspective view of the opening member, closing member and their interlocking mechanism according to the third modification and showing a state where the opening member is at a first position and the closing member is at a fourth position.

In this case, an interlocking mechanism shown in FIGS. 23A and 23B is provided for interlockingly moving four shutter drive members 44 (FIG. 10) by the operation of the single opening member 26 or the single closing member 32.

More specifically, lever parts 28 and 34 to be in the respective spaces 12 in the above-described embodiment are dispensed with regarding the second to fourth mechanisms except for the frontmost mechanism. A rack gear 111 extends in the frontward/rearward direction and is positioned above the pinion gears 40. The rack gear 111 has a lower surface provided with gear teeth meshedly engaged each pinion gear 40. The rack gear 111 is movable in the frontward/rearward direction.

Upon moving the closing member 32 from the third position (FIG. 23A) to the fourth position (FIG. 23B), the rotating support part 33, the left pinion gear 38 and the right pinion gear 39 are rotated about their axes in the counterclockwise direction as viewed from the left side. Therefore, the frontmost pinion gear 40 meshed with the right pinion gear 39 and the rotating support part 27 are rotated about their axes in the clockwise direction as viewed from the left side. Accordingly, the opening member 26 is moved from the second position (FIG. 23A) to the first position (FIG. 23B). Further, the rack gear 111 is moved frontward by the clockwise rotation of the frontmost pinion gear 40, so that remaining three pinion gears 40 are also rotated in the clockwise direction to rotate the three right pinion gears 39 and the three left pinion gears 38 in the counterclockwise direction. Consequently, four shutter drive members 44 are moved concurrently from the non-confronting position offset from the openings 43 to the rearward confronting position confronting the openings 43.

Upon moving the opening member 26 from the first position (FIG. 23B) to the second position (FIG. 23A), the rotating support part 27 and the pinion gear 40 coupled to the opening member 26 are rotated in the counterclockwise direction as viewed from the left side. Therefore, the frontmost right pinion gear 39 meshedly engaged with the frontmost pinion gear 40, the rotating support part 33 and the left pinion gear 38 are rotated in the clockwise direction as viewed from the left side. Accordingly, the closing member 32 is moved from the fourth position (FIG. 23B) to the third position (FIG. 23A). Further, the rack gear 111 is moved rearward by the counterclockwise rotation of the frontmost pinion gear 40, so that remaining three pinion gears 40 are also rotated in the counterclockwise direction to rotate the three right pinion gears 39 and the three left pinion gears 38 in the clockwise direction. Consequently, four shutter drive members 44 are moved concurrently from the confronting position confronting the openings 43 to the non confronting position offset from the openings 43.

With this structure, all shutters 73 (FIG. 17A, 17B) can be concurrently moved between the open positions and the closed positions by way of the operation to the single opening member 26 and the single closing member 32. Thus, enhanced operability can result.

(4) Fourth Modification

In the above-described embodiment, the single first cover 31 covers the four opening members 26 as shown in FIG. 4A, and the single second cover 37 covers the four closing members 32 as shown in FIG. 4B. However, in the fourth modification, four covers are provided for respectively covering four opening members 26 instead of the single first cover 31, and another four covers are provided for respectively covering four closing members 32 instead of the single second cover 37.

While the invention has been described in detail with reference to the embodiment and modifications thereof, it would be apparent to those skilled in the art that various changes and modifications may be made therein without departing from the spirit of the invention.

What is claimed is:

1. An image forming device comprising:

a main casing defining an accommodation space;

a holder unit configured to be movable in a moving direction between an accommodated position in which the holder unit is accommodated in the accommodation space and a pull-out position in which at least part of the holder unit is outside of the accommodation space, a plurality of image bearing members that are held by the holder unit and that are juxtaposedly arrayed in the moving direction with intervals between neighboring image bearing members;

a plurality of developing units that are held by the holder unit in one to one correspondence with the plurality of image bearing members;

a plurality of toner boxes that are detachably attachable to the holder unit in one to one correspondence with the plurality of developing units, each toner box being detachably attachable to the holder unit at the pull-out position, each toner box including: a toner container accommodating therein toner and formed with an opening through which toner in the toner container is to be supplied to each developing unit; and a shutter movable between an open position for opening the opening and a closed position for closing the opening; and an operation assembly provided at the holder unit and configured to move the shutter between the open position and the closed position.

2. The image forming device as claimed in claim 1, wherein the operation assembly comprises:

a first operation assembly movable between a first position and a second position and operable to be moved from the first position to the second position to move the shutter from the closed position to the open position; and a second operation assembly movable between a third position and a fourth position and operable to be moved from the third position to the fourth position to move the shutter from the open position to the closed position.

3. The image forming device as claimed in claim 2, wherein the operation assembly is configured to provide upward movement of at least part of the first operation assembly when the first operation assembly is moved from the first position to the second position and to provide upward movement of at least part of the second operation assembly when the second operation assembly is moved from the third position to the fourth position.

4. The image forming device as claimed in claim 3, wherein the holder unit comprises a pair of side plates extending in the moving direction and spaced away from each other to provide a space therebetween for accommodation of the toner box, the first operation assembly and the second operation assembly being positioned at outer sides of the pair of side plates opposite to the space.

5. The image forming device as claimed in claim 4, wherein the first operation assembly is provided at one of the side plates at a position opposite to the space with respect to the one of the side plates, and the second operation assembly is provided at remaining one of the side plates at a position opposite to the space with respect to the remaining one of the side plates.

6. The image forming device as claimed in claim 5, wherein the pair of side plates confront with each other in a confronting direction; and wherein the developing unit includes a shutter drive member that extends in the confronting direction and that is connectable with the shutter to move the shutter between the open position and the closed position, the shutter drive member having one end portion connected to the first operation assembly, and another end portion connected to the second operation assembly.

7. The image forming device as claimed in claim 5, wherein the first operation assembly and the second operation assembly are pivotally movable with respect to the side plates.

8. The image forming device as claimed in claim 7, wherein the first operation assembly is configured to provide a first pivoting direction as viewed from an outer side thereof opposite to the space when the first operation assembly moves from the first position to the second position, and the second operation assembly is configured to provide a second pivoting direction opposite to the first pivoting direction as viewed from an outer side of the second operation assembly opposite to the space when the second operation assembly moves from the third position to the fourth position.

9. The image forming device as claimed in claim 8, wherein the first operation assembly comprises a first rotating support part and a first lever part extending from the first rotating support part in a direction from the accommodated position toward the pull-put position, and the second operation assembly comprises a second rotating support part and a second lever part extending from the second rotating support part in a direction from the accommodated position to the pull-put position.

10. The image forming device as claimed in claim 9, wherein the first lever part of the first operation assembly extends horizontally at the second position, and the second lever part of the second operation assembly extends horizontally at the fourth position.

11. The image forming device as claimed in claim 7, wherein the first operation assembly is configured to provide a pivoting direction as viewed from an outer side thereof opposite to the space when the first operation assembly moves from the first position to the second position, and the second operation assembly is configured to provide a pivoting direction identical to the pivoting direction of the first operation assembly as viewed from an outer side of the second operation assembly opposite to the space when the second operation assembly moves from the third position to the fourth position.

12. The image forming device as claimed in claim 11, wherein the first operation assembly comprises a rotating support part and a first lever part extending from the rotating support part in a direction from the accommodated position toward the pull-out position, and the second operation assembly comprises the rotating support part and a second lever part extending from the rotating support part in a direction from the pull-out position to the accommodated position.

13. The image forming device as claimed in claim 11 wherein the first operation assembly comprises a rotating support part and a first lever part extending from the rotating support part in a direction from the pull-out position to the accommodated position, and the second operation assembly comprises the rotating support part and a second lever part extending from the rotating support part in a direction from the accommodated position to the pull-out position.

14. The image forming device as claimed in claim 2, further comprising a cover configured to cover the first operation assembly at the second position and the second operation assembly at the fourth position.

15. The image forming device as claimed in claim 14, wherein the first operation assembly comprises a plurality of first assemblies each provided for each toner box, and the second operation assembly comprises a plurality of second assemblies each provided for each toner box, and, wherein the cover comprises a first cover collectively covering the plurality of first assemblies, and a second cover collectively covering the plurality of second assemblies.

16. The image forming device as claimed in claim 14, wherein the cover is positioned above the first operation assembly and the second operation assembly.

17. The image forming device as claimed in claim 2, wherein the first operation assembly comprises a single first assembly for the plurality of toner boxes, and the second operation assembly comprises a single second assembly for the plurality of toner boxes, and, the image forming device further comprising an interlocking mechanism configured to interlockingly move the plurality of shutters of the plurality of toner boxes from closed positions to the open positions in accordance with the movement of the first assembly from the first position to the second position, and to interlockingly move the plurality of shutters of the plurality of toner boxes from open position to the closed position in accordance with the movement of the second assembly from the third position to the fourth position.

18. The image forming device as claimed in claim 2, wherein the first operation assembly is configured to move from the second position to the first position in interlocking relation to the movement of the second operation assembly from the third position to the fourth position, and the second operation assembly is configured to move from the fourth position to the third position in interlocking relation to the movement of the first operation assembly from the first position to the second position.

19. The image forming device as claimed in claim 1, wherein the holder unit includes a shutter drive member that is connected to the operation assembly and that is configured so as to be connectable with the shutter to move the shutter between the open position and the closed position.

* * * * *